US010967491B2

(12) United States Patent
Yasutomi et al.

(10) Patent No.: US 10,967,491 B2
(45) Date of Patent: Apr. 6, 2021

(54) DRIVER

(71) Applicant: KOKI HOLDINGS CO., LTD., Tokyo (JP)

(72) Inventors: Toshinori Yasutomi, Ibaraki (JP); Shinichirou Satou, Ibaraki (JP); Kazuhiko Funabashi, Ibaraki (JP); Yuki Mitoma, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 170 days.

(21) Appl. No.: 16/320,972

(22) PCT Filed: Jun. 30, 2017

(86) PCT No.: PCT/JP2017/024120

§ 371 (c)(1),
(2) Date: Jan. 25, 2019

(87) PCT Pub. No.: WO2018/020955

PCT Pub. Date: Feb. 1, 2018

(65) Prior Publication Data

US 2019/0168366 A1 Jun. 6, 2019

(30) Foreign Application Priority Data

Jul. 29, 2016 (JP) ..... JP2016-150460
Feb. 27, 2017 (JP) ..... JP2017-035065

(51) Int. Cl.
*B25C 1/04* (2006.01)
*B25C 1/06* (2006.01)
*B25C 1/00* (2006.01)

(52) U.S. Cl.
CPC ..... *B25C 1/047* (2013.01); *B25C 1/008* (2013.01); *B25C 1/04* (2013.01); *B25C 1/06* (2013.01)

(58) Field of Classification Search
CPC ..... B25C 1/047; B25C 1/04; B25C 1/008; B25C 1/06
(Continued)

(56) References Cited

U.S. PATENT DOCUMENTS 3,527,142 A * 9/1970 Obergfell ..... B25C 1/041 91/461
3,605,559 A * 9/1971 Korth ..... B27F 7/34 91/398
(Continued)

FOREIGN PATENT DOCUMENTS

JP 09-94769 A 4/1997
JP 2012-518553 A 8/2012
(Continued)

OTHER PUBLICATIONS

Extended European Search Report issued in corresponding European Patent Application No. 17833964.4-1017, dated Apr. 14, 2020.
(Continued)

*Primary Examiner* — Robert F Long
(74) *Attorney, Agent, or Firm* — McDermott Will & Emery LLP

(57) ABSTRACT

To provide a driver that can be reduced in the amount of gas to be injected into a pressure chamber. The driver has: an impactor configured to hit a stopper by moving from a first position toward a second position; a pressure chamber to be filled with gas for moving the impactor from the first position toward the second position; a control mechanism configured to move the impactor from the second position toward the first position; and a gas injection portion configured to inject gas into the pressure chamber, wherein the impactor is capable of taking a standby position between the second position and the first position, and the control mechanism is configured to stop the impactor at an adjustment
(Continued)

position closer to the second position than the standby position before gas is injected into the pressure chamber.

20 Claims, 20 Drawing Sheets

(58) Field of Classification Search
USPC ..... 227/8, 107–156; 173/90
See application file for complete search history.

(56) References Cited

U.S. PATENT DOCUMENTS

| | | | | |
|---|---|---|---|---|
| 5,720,423 | A | 2/1998 | Kondo et al. | |
| 10,335,874 | B2 * | 7/2019 | Iwata | B23D 51/10 |
| 2002/0125290 | A1 * | 9/2002 | Robinson | B25C 1/043 227/8 |
| 2005/0242154 | A1 | 11/2005 | Leimbach | |
| 2010/0213235 | A1 | 8/2010 | Pedicini et al. | |
| 2013/0082083 | A1 * | 4/2013 | Largo | B25C 1/041 227/8 |
| 2015/0158160 | A1 * | 6/2015 | Kato | F15B 15/149 91/35 |
| 2015/0202755 | A1 | 7/2015 | Tanji | |
| 2016/0158927 | A1 * | 6/2016 | Largo | B25C 1/04 220/582 |
| 2016/0214250 | A1 * | 7/2016 | Sun | B25B 21/00 |

FOREIGN PATENT DOCUMENTS

| | | | |
|---|---|---|---|
| JP | 2015-077676 | A | 4/2015 |
| JP | 2015-223680 | A | 12/2015 |
| JP | 5849920 | B2 | 2/2016 |
| WO | 2014/050066 | A2 | 4/2014 |
| WO | 2014/050066 | A3 | 10/2014 |

OTHER PUBLICATIONS

International Search Report issued in corresponding International Patent Application No. PCT/JP2017/024120, dated Aug. 1, 2017, with English Translation.

* cited by examiner

10: DRIVER
12: IMPACTOR
13: PRESSURE CHAMBER
58: STOPPER

DRIVER

CROSS REFERENCE TO RELATED APPLICATIONS

This application is the U.S. National Phase under 35 US.C. § 371 of International Application No. PCT/JP2017/024120, filed on Jun. 30, 2017, which claims the benefit of Japanese Application No. 2016-150460, filed on Jul. 29, 2016 and Japanese Application No. 2017-035065, filed on Feb. 27, 2017, the entire contents of each are hereby incorporated by reference.

TECHNICAL FIELD

The present disclosure relates to a driver in which an impactor is moved by a pressure of gas refilled in a pressure chamber, and a stopper is then hit by the impactor.

BACKGROUND ART

Conventionally, there has been known a driver in which a pressure chamber filled with gas such as air or inert gas, a piston is pressed by the pressure of this gas, and an impactor is then moved by the piston. Such a driver is described in Patent Document 1. The driver includes: a cylinder provided in a housing; a piston movably accommodated in the cylinder; a driver blade fixed to the piston; a pressure chamber formed in the cylinder; and a gas filling valve as a gas pressure adjusting mechanism provided in the housing. The pressure chamber is filled with compressed gas from a nitrogen gas cylinder provided outside the housing through a gas hose and a gas filling valve. A seal member is interposed between the cylinder and the piston, and the seal member is configured to maintain an airtightness of the pressure chamber.

The piston and the driver blade are an impactor. Additionally, the driver includes: a motor provided in the housing; a series of gears to which a rotation force is transmitted from the electric motor; and a cam which is rotated by the rotation force transmitted from the series of gears. The cam has a projection that is engaged with and disengaged from the piston.

In the driver described in Patent Document 1, the rotation force of the electric motor is transmitted to the cam via the series of gears. With the projection engaged with the piston, the piston is moved from a bottom dead center toward a top dead center by the power of the cam. When the piston is moved from the bottom dead center toward the top dead center, the pressure in the pressure chamber rises. When the piston reaches the top dead center, the projection is disengaged from the piston, and the power of the cam is not transmitted to the piston. Then, an impacting force corresponding to the pressure of the pressure chamber is applied to the driver blade, and the driver blade drives a nail into an object material.

BACKGROUND ART

Patent Documents

Patent Document 1: Japanese Patent Publication No. 5849920

SUMMARY OF THE INVENTION

Problems to be Solved by the Invention

In a driver in which a stopper is driven by such a compressed gas as an elastic body, it is necessary to refill the pressure chamber with gas such as air or inert gas to increase its pressure to a predetermined pressure level when the pressure in the pressure chamber drops. In this case, since the pressure of the gas depends on the volume of the closed space, it is necessary to define the volume of the sealed space in order to define the predetermined pressure. Furthermore, if the pressure chamber can be refilled with gas by relatively low pressure, it is possible to use simple refilling means without using a large apparatus such as a compressor. For example, a small simple compressor, a simple motor pump, a manual compression pump may be used as the refilling means.

It is an object of the present invention to provide a driver in which a pressure chamber can be easily refilled with gas at a predetermined level.

Means for Solving the Problem

According to one aspect of the present invention, there is provided a driver comprising: an impactor configured to hit a stopper by moving from a first position toward a second position; a pressure chamber to be filled with gas for moving the impactor from the first position toward the second position; a control mechanism configured to move the impactor from the second position toward the first position; and a gas injection portion configured to inject gas into the pressure chamber, wherein the impactor is capable of taking a standby position between the second position and the first position, and the control mechanism is configured to stop the impactor at an adjustment position closer to the second position than the standby position before gas is injected into the pressure chamber.

Effects of the Invention

In the driver according to one embodiment, the pressure chamber can be easily refilled with gas at a predetermined pressure.

DESCRIPTION OF THE PREFERRED EMBODIMENTS

Hereinafter, embodiments of a driver will be described in detail with reference to the drawings.

Figure 1:
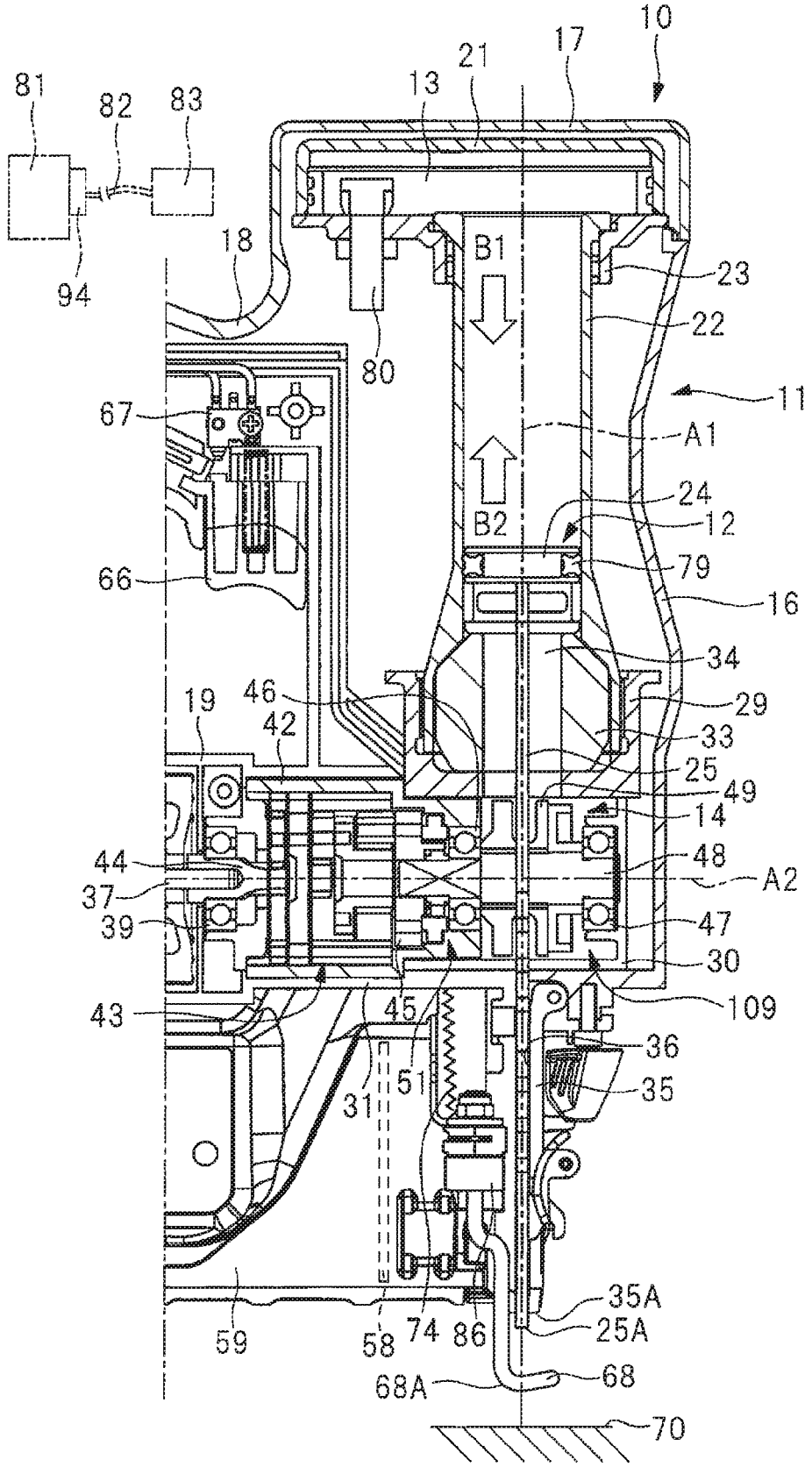
FIG. 1 is a side cross-sectional view of a driver according to one embodiment of the present invention.
Figure 2:
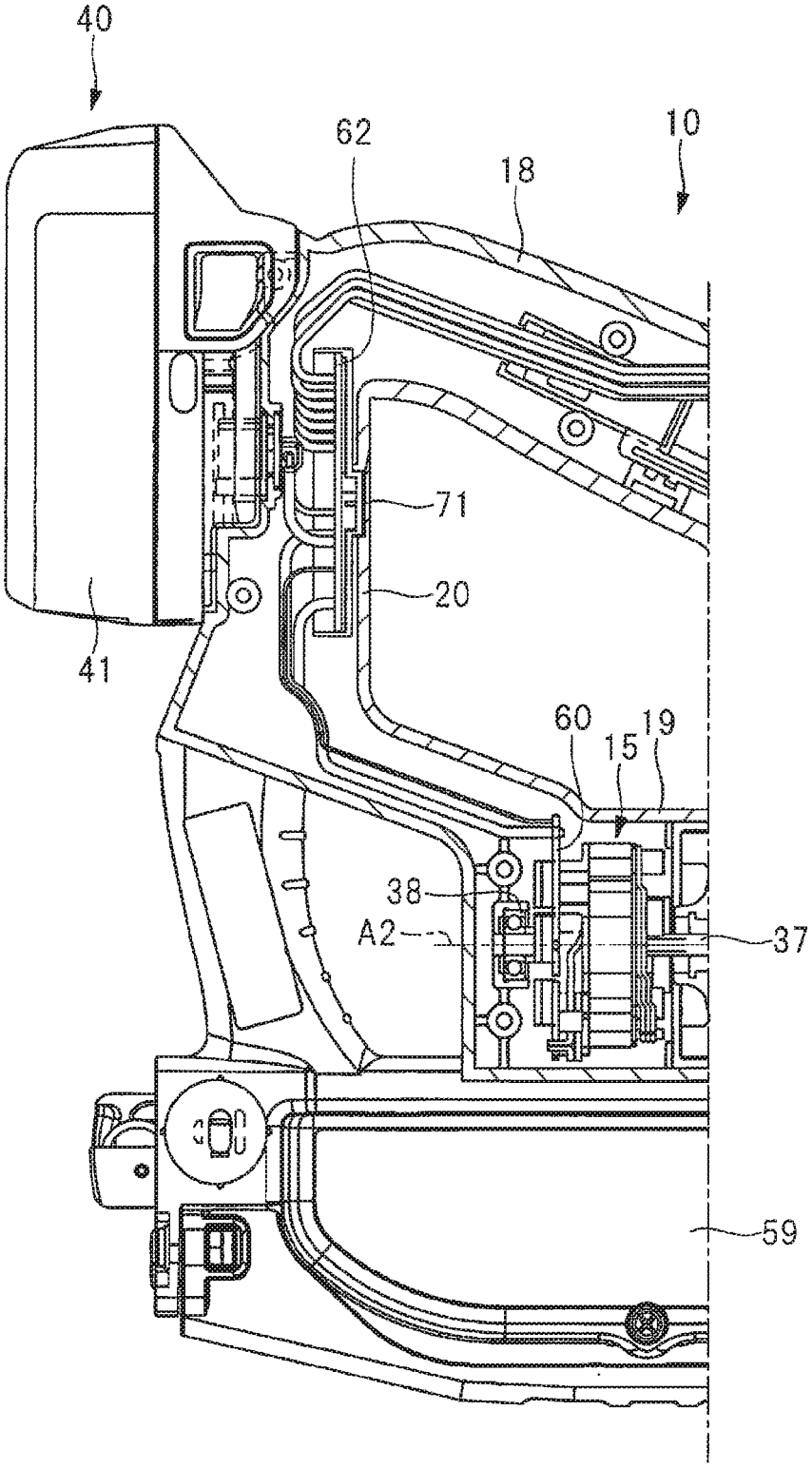
FIG. 2 is a side cross-sectional view of the driver according to the embodiment.
Figure 3:
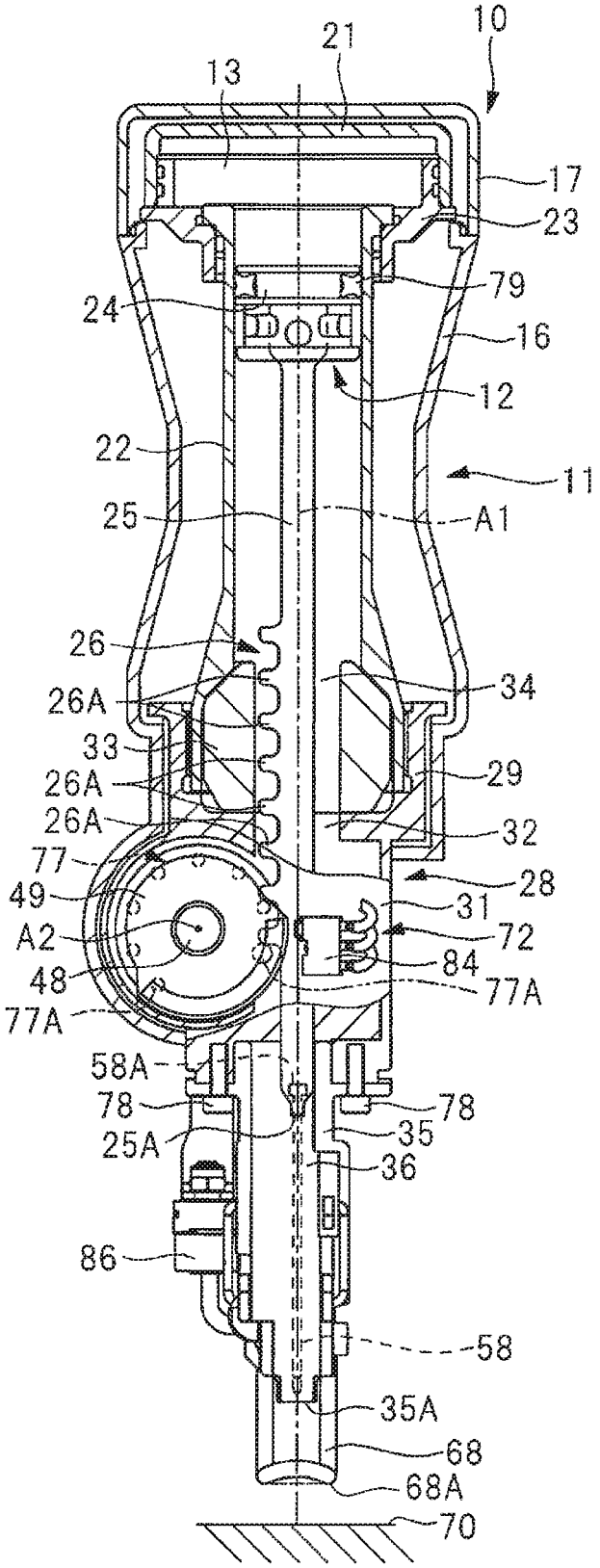
FIG. 3 is a front cross-sectional view showing the driver shown in FIG. 1.

A driver 10 is shown in FIGS. 1, 2 and 3. The driver 10 has: a cylindrical housing 11; an impactor 12 disposed so as to extend from the inside to the outside of the housing 11; a pressure chamber 13 configured to move the impactor 12 from a top dead center toward a bottom dead center in a first direction B1; a power conversion mechanism 14 configured to move the impactor 12 in a second direction B2 opposite to the first direction, and an electric motor 15 configured to transmit a rotation force to the power conversion mechanism 14.

The housing 11 has: a main body 16; a cover 17 configured to close an opening of the main body 16; a handle 18 and a motor accommodating portion 19 that are continuous with the main body 16; and a connecting portion 20 configured to connect the handle 18 and the motor accommodating portion 19. A pressure accumulating container 21 and a cylinder 22 are provided in the housing 11, and an annular connector 23 is configured to connect the pressure accumulating container 21 and the cylinder 22. The pressure chamber 13 is formed in the pressure accumulating container 21. The connector 23 is provided with a valve 80. The valve 80 has: a passage connected to the pressure chamber 13; and a valve body configured to open and close the passage. The valve 80 is provided to the main body 16.

A gas compressor 81 and a pressure regulator 94 are provided separately from the driver, and connected to the driver 10 via an air hose 82. The gas compressor 81 and the pressure regulator 94 are not included in the structure of the driver 10. In this embodiment, the pressure regulator 94 is preferably a pressure reduction valve. An adapter 83 is attached to the air hose 82. By detaching the cover 17 from the main body 16, the air hose 82 can be inserted into the main body 16. The adapter 83 is connectable to and detachable from the valve 80. By connecting the adapter 83 to the valve 80, the valve 80 opens the passage. By detaching the adapter 83 from the valve 80, the valve 80 closes the passage.

The impactor 12 has: a piston 24 movably arranged in the cylinder 22: and a driver blade 25 fixed to the piston 24. The piston 24 is movable in a direction of the center line A1 of the cylinder 22. The direction of the center line A1 is parallel to the first direction B1 and the second direction B2. A seal member 79 is attached to the outer periphery of the piston 24, and the seal member 79 contacts the inner surface of the cylinder 22 to form a seal surface. The seal member 79 hermetically seals the pressure chamber 13.

The pressure chamber 13 is filled with a compressed gas and sealed. For example, the pressure chamber 13 may be filled with inert gas, nitrogen gas, rare gas, or the like together with air. In this embodiment, as one example, the pressure chamber 13 is filled with dry air.

The driver blade 25 is preferably made of metal, and part of the driver blade 25 may be coated with resin or the like, or may be bonded to a different metal. As shown in FIG. 3, a rack is provided along a longitudinal direction of the driver blade 25. The rack 26 has a plurality of projections 26A. The projections 26A are arranged at regular intervals in the direction of the center line A1.

A holder 28 is disposed so as to extend from the inside to the outside of the main body 16. The holder 28 is made of aluminum alloy or synthetic resin. The holder 28 has: a cylindrical load receiving portion 29, an arc-shaped cover 30 continuous with the load receiving portion 29, and a tail portion 31 continuous with the load receiving portion 29. As shown in FIG. 1, the tail portion 31 is continuous with the motor accommodating portion 19.

The load receiving portion 29 is disposed in the main body 16, and the load receiving portion 29 has an axial hole 32. A bumper 33 is provided to the load receiving portion 29. The bumper 33 is formed of rubber-like elastic material by integral molding. The bumper 33 has an axial bore 34. The axial bores 32 and 34 are arranged about the center line A1, and the driver blade 25 is movable in the axial bores 32 and 34 in the direction of the center line A1. The cover 30 is disposed within the tail portion 31. A nose portion 35 is fixed to the tail portion 31 using a screw member 78, and the nose portion 35 has an injection path 36. The injection path 36 is a space or a passage, and the driver blade 25 is movable in the direction of the center line A1 in the injection path 36.

The electric motor 15 is provided to the motor accommodating portion 19. The electric motor 15 has a motor shaft 37, and the motor shaft 37 is rotatably supported by bearings 38 and 39. The motor shaft 37 is rotatable about an axis A2. As shown in FIG. 2, a secondary battery 40 is provided and detachable from the connecting portion 20, and the secondary battery 40 is configured to supply an electric power to the electric motor 15.

The secondary battery 40 has: a housing case 41; and a battery cell accommodated in the housing case 41. This battery cell is a rechargeable battery, and any of a lithium ion battery, a nickel metal hydride battery, a lithium ion polymer battery, and a nickel cadmium battery may be used as the battery cell. The secondary battery 40 is a DC power source. A first terminal is provided in the housing case 41, and the first terminal is connected to the battery cell. When the second terminal is fixed to the connecting portion 20 and the secondary battery 40 is attached to the connecting portion 20, the first terminal and the second terminal are electrically connected to each other.

As shown in FIG. 1, a gear case 42 is provided to the tail portion 31, and a speed reducer 43 is provided in the gear case 42. The speed reducer 43 has: an enter member 44; an output member 45; and three sets of planetary gear mechanisms. The enter member 44 is fixed to the motor shaft 37. The enter member 44 and the output member 45 are rotatable about the axis A2. The rotation force of the motor shaft 37 is transmitted to the output member 45 via the enter member 44. The speed reducer 43 is configured to reduce the rotation speed of the output member 45 with respect to the enter member 44.

The power conversion mechanism 14 is disposed in the cover 30. The power conversion mechanism 14 has: a pin wheel shaft 48; a pin wheel 49 fixed to the pin wheel shaft 48; and a pinion mechanism 77 provided to the pin wheel 49. The pin wheel shaft 48 is rotatably supported by bearings 46 and 47. The pinion mechanism 77 has a plurality of pins 77A spaced from each other in a circumferential direction of the pin wheel 49. The projections 26A constituting the rack 26 is the same in number as the pins 77A constituting the pinion mechanism 77. The bearings 46 and 47 are disposed at respective positions different from each other in a direction of the axis A2, and the bearing 46 is disposed between the speed reducer 43 and the bearing 47. The power conversion mechanism 14 is disposed between the bearings 46 and 47 in the direction of the center line A1. The power conversion mechanism 14 is configured to convert the rotation force of the pin wheel 49 into a moving force of the impactor 12. The speed reducer 43, the power conversion mechanism 14, and the projections 26A form a power transmission route 109.

A rotation restricting mechanism 51 is provided in the gear case 42. The rotation restricting mechanism 51 is disposed in a power transmission route between the motor shaft 37 and the pin wheel 49. The rotation restricting mechanism 51 is disposed between the bearing 46 and the output member 45 in the direction of the axis A2. The rotation restricting mechanism 51 is a mechanism configured to transmit the rotation force of the output member 45 to the pin wheel shaft 48. The rotation restricting mechanism 51 is configured to transmit the rotation force of the output member 45 to the pin wheel shaft 48 regardless of the rotation direction of the output member 45. The rotation restricting mechanism 51 has a function of preventing the pin wheel shaft 48 from being rotated by the force transmitted from the driver blade 25.

Furthermore, it is provided with a magazine 59 configured to receive nails 58, the magazine 59 being supported by the nose portion 35 and the connecting portion 20. The magazine 59 has a feeding mechanism is configured to feed the nails 58 to the injection path 36.

Figure 5:
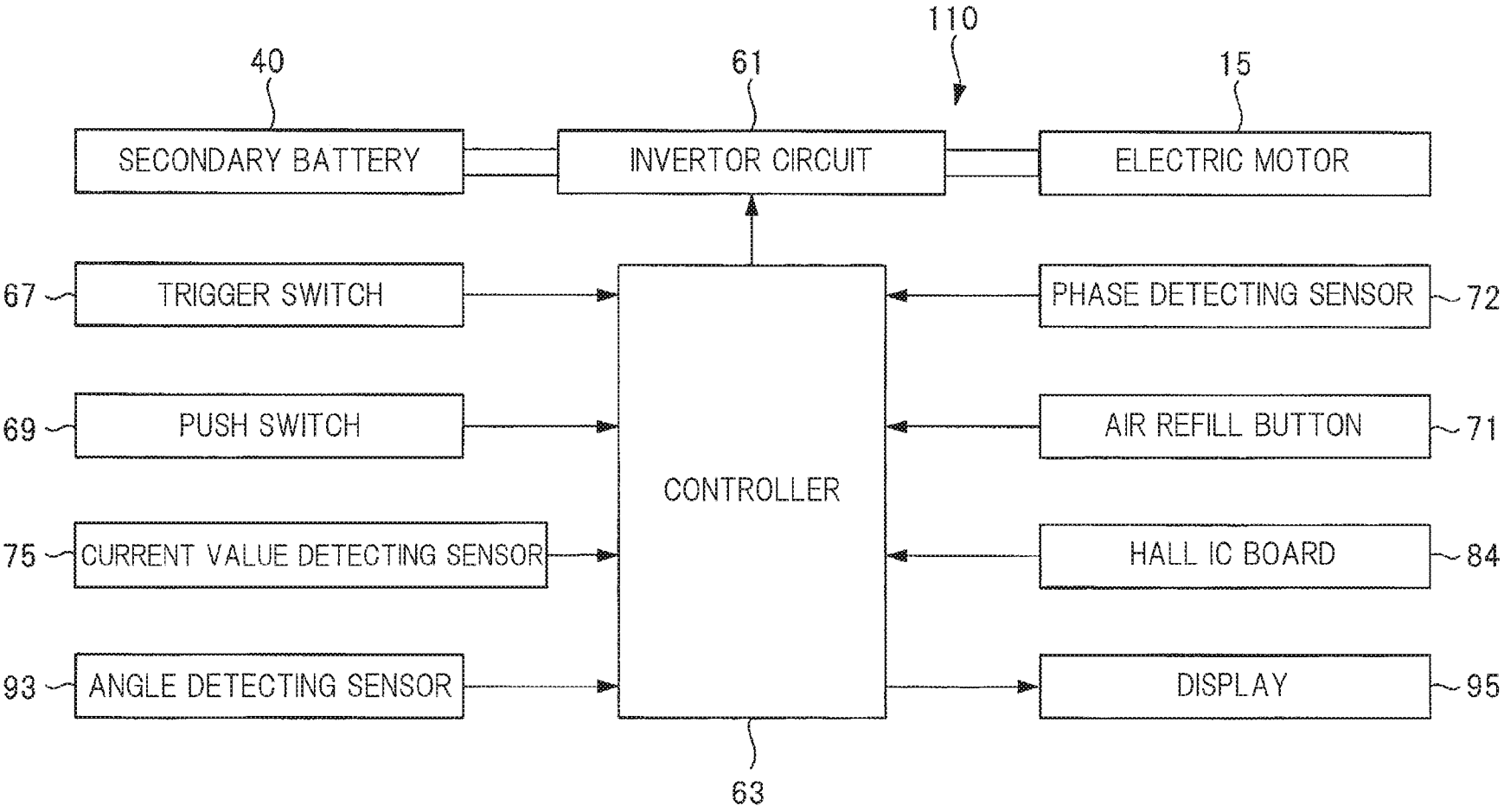
FIG. 5 is a block diagram showing a control system of the driver.

A motor board 60 is provided in the motor accommodating portion 19, and an inverter circuit 61 shown in FIG. 5 is provided to the motor board 60. The inverter circuit 61 has a multiple of switching elements, and the switching elements can be individually turned on and off.

As shown in FIG. 2, a control board 62 is provided to the connecting portion 20, and a controller 63 shown in FIG. 5 is provided to the control board 62. The controller 63 is a microcomputer having an enter port, an output port, a central processing unit, and a storing device. The controller 63 is connected to the second terminal and the inverter circuit 61.

As shown in FIG. 1, the handle 18 is provided with a trigger 66. Trigger 66 is mounted and movable with respect to the handle 18. A trigger switch 67 is provided to the handle 18, and the trigger switch 67 performs, for example, a switching operation from "OFF" to "ON" when an operation force is applied to the trigger 66. Furthermore, the trigger switch 67 performs, for example, an operation of switching from "ON" to "OFF" when the operation force applied to the trigger 66 is released.

A push lever 68 is attached to the nose portion 35. The push lever 68 is movable in the direction of the center line A1 with respect to the nose portion 35. As shown in FIG. 1, it is provided with an elastic member 74 configured to urge the push lever 68 in the direction of the center line A1. The elastic member 74 is a compression coil spring made of metal, and the elastic member 74 is configured to urge the push lever 68 away from the bumper 33. The nose portion 35 is provided with a push lever stopper 86, and the push lever 68 biased by the elastic member 74 stops by coming in contact with the push lever stopper 86.

A push switch 69 shown in FIG. 5 is provided to the nose portion 35. The push switch 69 is turned on when the push lever 68 is pressed against an object material 70 into which it is driven, and moved by a predetermined amount from the position where the push lever 68 comes in contact with the push lever stopper 86 toward the bumper 33. The push switch 69 is turned off when the force pressing the push lever 68 against the object material 70 is released and the push lever 68 moves away from the bumper 33 by the force of the elastic member 74.

Figure 6A:
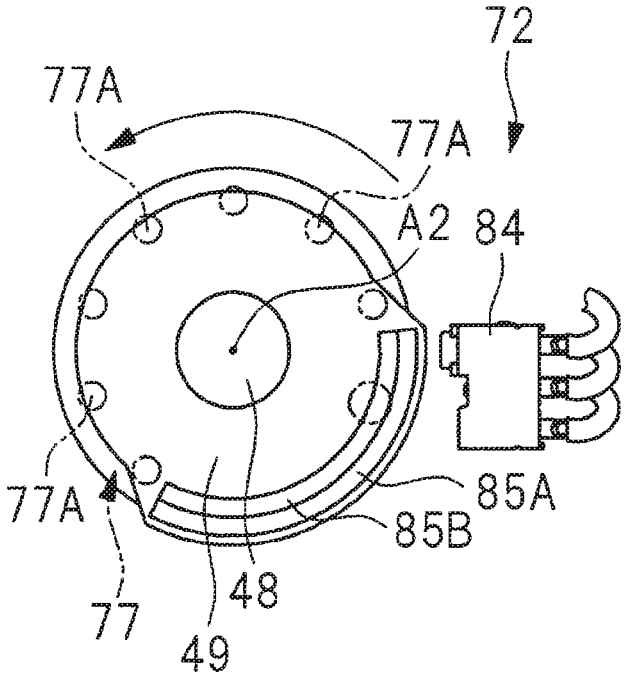
FIG. 6A is a diagram showing one example of a phase detection sensor provided to the driver.
Figure 6B:
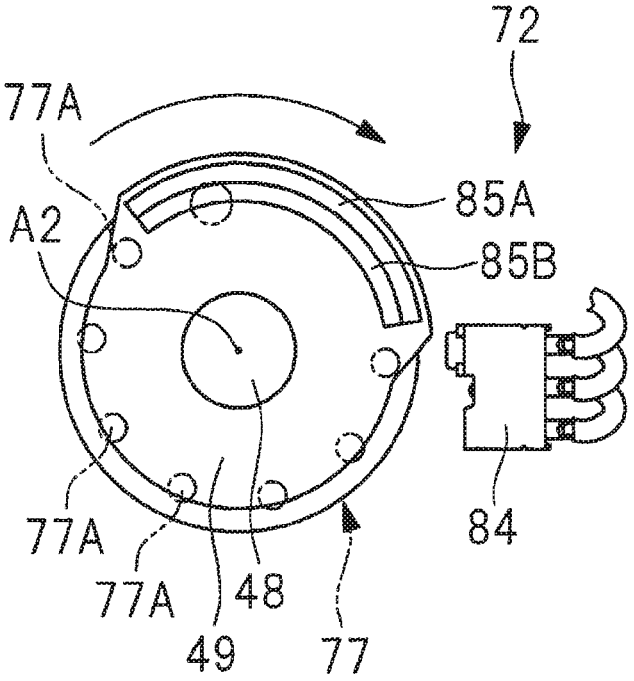
FIG. 6B is a diagram showing the example of the phase detection sensor provided to the driver.

A phase detection sensor 72 is provided and configured to detect the rotation angle, that is, the phase, of the pin wheel 49. The phase detection sensor 72 includes a Hall IC board 84 and permanent magnets 85A and 85B shown in FIGS. 6A and 6B. The Hall IC board 84 is provided to the tail portion 31, and the permanent magnets 85A and 85B are attached to the pin wheel 49. The permanent magnet 85A has an N-pole and the permanent magnet 85B has an S-pole. Each of the permanent magnets 85A and 85B is arc-shaped, and the permanent magnets 85A and 85B are arranged within the same range in the rotation direction of the pin wheel 49. The Hall IC board 84 is configured to output a signal corresponding to the intensity of the magnetic field formed by the permanent magnets 85A and 85B. The Hall IC board 84 is separated from the permanent magnets 85A and 85B. The phase detection sensor 72 is a non-contact sensor.

As shown in FIG. 2, an air refilling button 71 is provided to the connecting portion 20. The operator can operate the air refilling button 71 to turn on and off. The current value detection sensor 75 shown in FIG. 5 is configured to detect a current value of an electrical circuit connecting the secondary battery 40 and the electric motor 15. An angle detection sensor 93 is provided and configured to detect the rotation angle of the motor shaft 37 and to output a signal. A signal of the trigger switch 67, a signal of the push switch 69, an on/off signal of the air refilling button 71, a signal of the phase detection sensor 72, a signal of the current value detection sensor 75, and a signal of the angle detection sensor 93 are input to the controller 63.

In the driver 10, a display 95 is provided to the housing 11, and the display 95 includes a LCD display and a lamp. The display 95 is connected to the controller 63 and configured to display the use mode of the driver 10. The display 95 functions with the electric power of the secondary battery 40.

An example of the operation in which the operator uses the driver 10 and an example of the control performed by the controller 63 are as follows. The controller 63 is configured to determine whether a condition for hitting the nail 58 is satisfied. When the trigger switch 67 is turned off and the push switch 69 is turned off, the controller 63 determines that the condition for hitting the nail 58 is not satisfied, and turns off all the switching elements of the inverter circuit 61.

Therefore, the electric power of the secondary battery 40 is not supplied to the electric motor 15, and the electric motor 15 is stopped.

Furthermore, the pin 77A of the pinion mechanism 77 is engaged with the projections 26A of the rack 26, and the piston 24 stops away from the bumper 33 as shown in FIG. 3. That is, the piston 24 stops at the standby position between the bottom dead center and the top dead center. When the piston 24 is stopped in the standby position, the tip 25A of the driver blade 25 is located between the head 58A of the nail 58 and the tip 35A of the nose portion 35 in the direction of the center line A1.

As shown in FIG. 3, when the piston 24 stops at the standby position and the tip 68A of the push lever 68 is separated from the object material 70, the push lever 68 stops by coming in contact with the push lever stopper 86. Therefore, the tip 68A of the push lever 68 protrudes from the tip 35A of the nose portion 35 by a predetermined amount in the direction of the center line A1. The tip 68A of the push lever 68 is located in front of the tip 25A of the driver blade 25 in the direction of the center line A1.

The bottom dead center of the piston 24 is a position where the piston 24 is pressed against the bumper 33 in the direction of the center line A1, as shown in FIG. 1. When the piston 24 is at the bottom dead center, the tip 25A of the driver blade 25 protrudes by a predetermined amount from the tip 35A of the nose portion 35. The tip 25A of the driver blade 25 is located between the tip 35A and the tip 68A of the push lever 68 in the direction of the center line A1. The top dead center of the piston 24 is a position where the piston 24 is closest to the pressure chamber 13 in the direction of the center line A1 in FIGS. 1 and 3.

Figure 7:
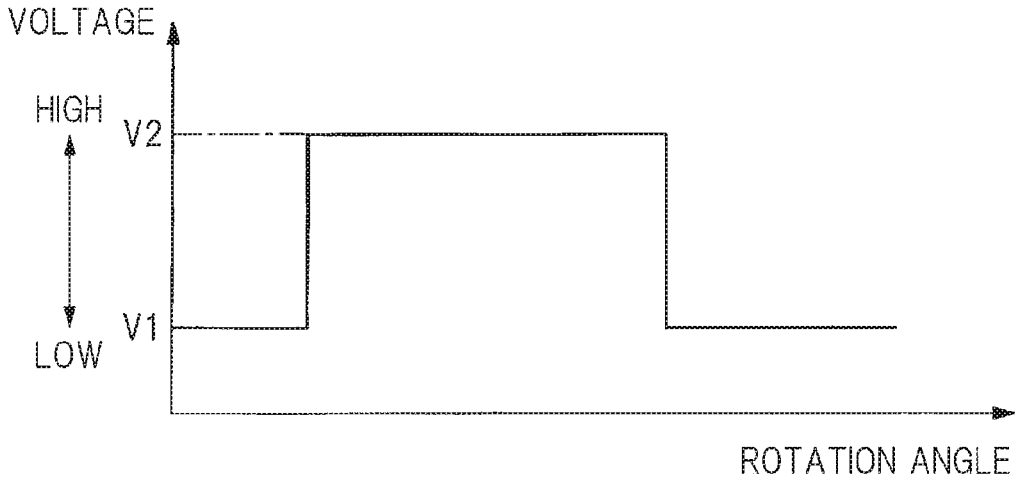
FIG. 7 is a diagram showing a voltage of a signal output from the phase detection sensor.

Furthermore, the controller 63 is configured to detect that the piston 24 is in the standby position based on the voltage of the signal output from the Hall IC board 84, and the controller 63 stops the electric motor 15. When the relative position between the Hall IC board 84 and the permanent magnets 85A and 85B is in the state shown in FIG. 6A, the controller 63 is configured to detect that the voltage of the signal of the Hall IC board 84 is the voltage V2 shown in FIG. 7, and to determine that the piston 24 is in the standby position.

When the electric motor 15 is stopped, the rotation restricting mechanism 51 holds the piston 24 at the standby position. The piston 24 and the driver blade 25 receive the urging force of the pressure chamber 13, and the urging force received by the driver blade 25 is transmitted to the pin wheel shaft 48 via the pin wheel 49. When the pin wheel shaft 48 receives a rotation force in FIG. 3, the rotation restricting mechanism 51 receives the rotation force, and prevents the pin wheel shaft 48 from being rotated. In this manner, the piston 24 is stopped in the standby position shown in FIG. 3.

When the trigger switch 67 is turned on and the push switch 69 is turned on, the controller 63 determines that the condition for hitting the nail 58 is satisfied, repeats the control of turning on and off the switching element of the inverter circuit 61, and supplies the electric power of the secondary battery 40 to the electric motor 15. Then, the motor shaft 37 of the electric motor 15 is rotated in a forward direction. The rotation force of the motor shaft 37 is transmitted to the pin wheel shaft 48 via the speed reducer 43.

The rotational directions of the motor shaft 37 and the output member 45 are the same as each other, and when the output member 45 is rotated, the rotation force of the output member 45 is transmitted to the pin wheel 49, and the pin wheel 49 is rotated in a counterclockwise direction in FIG. 3. The pin wheel shaft 48 is the same in rotation direction as the pin wheel 49. That is, when the motor shaft 37 is rotated in the normal direction, the pin wheel shaft 48 and the pin wheel 49 are rotated in the counterclockwise direction in FIG. 3.

When the pin wheel 49 is rotated in the counterclockwise in FIG. 3, the rotation force of the pin wheel 49 is transmitted to the driver blade 25 and the piston 24, and the piston 24 is moved toward the pressure chamber 13 in the direction of the center line A1. That is, the air pressure in the pressure chamber 13 rises by moving the piston 24 from the standby position toward the top dead center.

When the piston 24 reaches the top dead center, the tip 25A of the driver blade 25 is positioned above the head 58A of the nail 58. When the piston 24 reaches the top dead center, the pin 77A of the pinion mechanism 77 is released from the projections 26A of the rack 26. Therefore, the piston 24 and the driver blade 25 are moved toward the bottom dead center by the air pressure of the pressure chamber 13. As a result, the driver blade 25 hits a head portion 58A of the nail 58 in the injection path 36, and the nail 58 is driven into the object material 70.

Furthermore, when the entire nail 58 is caught in the object material 70 and the nail 58 stops, its reaction force causes the tip 25A of the driver blade 25 to leave the head 58A of the nail 58. Then, the piston 24 collides with the bumper 33, and the bumper 33 is elastically deformed to absorb kinetic energy of the piston 24 and the driver blade 25.

Furthermore, the motor shaft 37 of the electric motor 15 is rotated in the forward direction even after the driver blade 25 hits the nail 58. Then, when the pin 77A of the pinion mechanism 77 is engaged with the projections 26A of the rack 26, the piston 24 rises again in FIG. 1 by the rotation force of the pin wheel 49. The controller 63 detects that the piston 24 has reached the standby position shown in FIG. 3, and stops the electric motor 15.

When the electric motor 15 stops, the rotation regulating mechanism 51 holds the piston 24 at the standby position. That is, the piston 24 stops before reaching the top dead center in the process of moving from the bottom dead center toward the top dead center. The standby position of the piston 24 shown in FIG. 3 is above an intermediate position defined between the top dead center and the bottom dead center in the direction of the center line A1. Furthermore, a stroke volume by which the piston 24 is moved from the bottom dead center to the standby position exceeds ½ of a stroke amount by which the piston 24 is moved from the bottom dead center to the top dead center.

In the driver 10, the standby position of the piston 24 is set between the top dead center and the bottom dead center. Therefore, a time required for driving one nail 58 can be reduced, thereby improving its workability. Note that the required time is a time from when the trigger switch 67 is turned on and the push switch 69 is turned on to start the movement of the piston 24 toward the top dead center to when the driver blade 25 drives the nail 58 into the object material 70.

First Control Example

In the driver 10, when the air pressure in the pressure chamber 13 drops or when the actual driving force of the driver 10 is lower than the target driving force, the operator can inject air into the pressure chamber 13. The actual driving force of the driver 10 is determined by the maximum pressure of the pressure chamber 13 and the pressure receiving area of the piston 24 with the piston 24 positioned the top dead center. The pressure receiving area of the piston 24 is defined by the area of the piston 24 that receives the pressure of the pressure chamber 13 in a plan view perpendicular to the center line A1.

The maximum pressure of the pressure chamber 13 is determined from the compression ratio corresponding to the stroke volume of the piston 24. The compression ratio is a value obtained by dividing the maximum volume of the pressure chamber 13 by the minimum volume of the pressure chamber 13. The minimum volume of the pressure chamber 13 is the volume of the pressure chamber 13 with the piston 24 positioned at the top dead center. The maximum volume of the pressure chamber 13 in this embodiment is recognized as the volume of the pressure chamber 13 with the piston 24 stopped in order to inject compressed air into the pressure chamber 13.

Since the pressure receiving area of the piston 24 is constant in the single driver 10, the actual driving force of the driver 10 can be adjusted by adjusting the maximum pressure of the pressure chamber 13. The pressure defining the driving force is determined by conditions, for example, the length of the nail 58 and the hardness of the object material 70, within a predetermined maximum defined by the main body 16 of the driver 10. The greater the length of the nail 58, the greater the hardness of the object material 70, the greater the required target driving force.

The operation of injecting air into the pressure chamber 13 by the operator and the control example performed by the controller 63 will be described with reference to the first control example of FIG. 8. In step S10, the controller 63 detects that the piston 24 stops at the standby position and the air refilling button 71 is turned on, and makes a determination in step S11. In step S11, the controller 63 determines whether the trigger switch 67 is turned on and the push switch 69 is turned on within a specified time after the air refilling button 71 is turned on.

If the determination in step S11 is affirmative "YES", the controller 63 moves the piston 24 from the standby position toward the bottom dead center in step S12. Specifically, the electric motor 15 is rotated in a reverse direction. Then, the pin wheel 49 is rotated in a clockwise direction in FIG. 3, and the piston 24 is moved toward the bottom dead center.

Additionally, when the controller 63 detects that the piston 24 has been moved to the lower dead center shown in FIG. 1, the motor 15 is stopped. The controller 63 detects from the signal from the angle detection sensor 93 that the piston 24 has been moved from the standby position to the bottom dead center. When the piston 24 stops at bottom dead center, the tip 25A of the driver blade 25 protrudes from the tip 35A of the nose portion 35 in the direction of the center line A1.

With the piston 24 stopped at the bottom dead center, the operator performs an air refilling operation in step S13. In step S13, the adapter 83 is connected to the valve 80, and the pressure of compressed air supplied from the gas compressor 81 is reduced by the pressure regulator 94 and supplied to the pressure chamber 13. The pressure of compressed air supplied to the pressure chamber 13 is set in accordance with a target driving force for each model of the driver 10.

When the air refilling operation is completed, the operator turns off the air refilling button 71. When the controller 63 detects that the air refilling button 71 is turned off in step S14, the controller 63 rotates the electric motor 15 in the reverse direction to move the piston 24 toward the top dead center and stops the piston 24 at the standby position in step S15. The controller 63 then selects the nailing mode in step S16, and ends the first control example of FIG. 8. Thus, the fourth control is to move the piston 24 from the bottom dead center to the standby position after compressed air is supplied to the pressure chamber 13.

Note that when a negative determination is made by the controller 63 in step S11, it proceeds to step S16. When the trigger switch 67 is turned on and the push switch 69 is turned on while the nail driving mode is selected, the controller 63 drives the nail 58 by rotating the electric motor 15 forward, and then moves the piston 24 to the standby position to stop the electric motor 15. When at least one of the trigger switch and the push switch 69 is off when the nailing mode is selected, the controller 63 stops the electric motor 15 and stops the piston 24 at the standby position.

As described above, when compressed air is injected into the pressure chamber 13, the piston 24 is stopped at the bottom dead center. Therefore, the air pressure to be injected into the pressure chamber 13 can be set low.

Second Control Example

The operation of injecting air into the pressure chamber 13 by the operator and the control example performed by the controller 63 will be described with reference to the second control example of FIG. 9. In the second control example of FIG. 9, steps for performing the same processing as in the first control example of FIG. 8 are given the same step numbers as in FIG. 8. In the second control example of FIG. 9, when the controller 63 makes an affirmative determination in step S11, it proceeds to step S20, and the piston 24 is moved from the standby position to the adjustment position.

Figure 4:
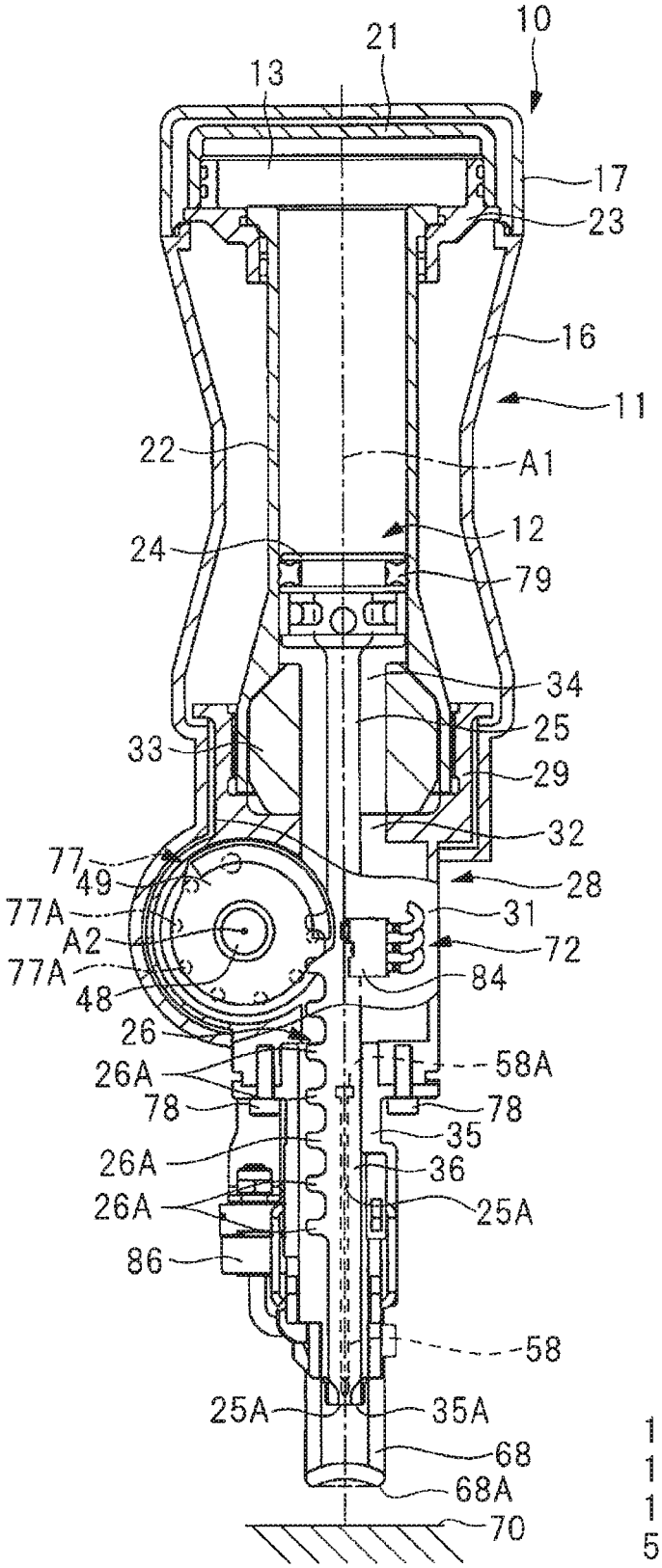
FIG. 4 is a front cross-sectional view showing the driver shown in FIG. 1.

That is, the electric motor 15 is rotated in the reverse direction, the pin wheel 49 is rotated in the clockwise direction in FIG. 3, the piston 24 is moved from the standby position toward the bottom dead center, and the electric motor is stopped when the piston 24 reaches the adjustment position shown in FIG. 4. When the relative position between the Hall IC board 84 and the permanent magnets 85A and 85B is in the state of FIG. 6B, the controller 63 detects that the voltage of the signal of the Hall IC board 84 has dropped from the voltage V2 shown in FIG. 7 to the voltage V1, and determines that the piston 24 has reached the adjustment position.

The adjustment position of the piston 24 shown in FIG. 4 is between the top dead center and the bottom dead center, more specifically, between the bottom dead center and the standby position. The adjustment position of the piston 24 is below an intermediate position defined between the top dead center and the bottom dead center in the direction of the center line A1. The stroke volume of the piston 24 from the bottom dead center to the adjustment position is less than ½ of the stroke amount by which the piston 24 is moved from the bottom dead center to the top dead center.

When the air refilling operation is performed in step S13 next to step S20, and the controller 63 detects that the air refilling button 71 is turned off in step S14, it proceeds to step S16. When a negative determination is made in step S11, it proceeds to step S16.

Figure 9:
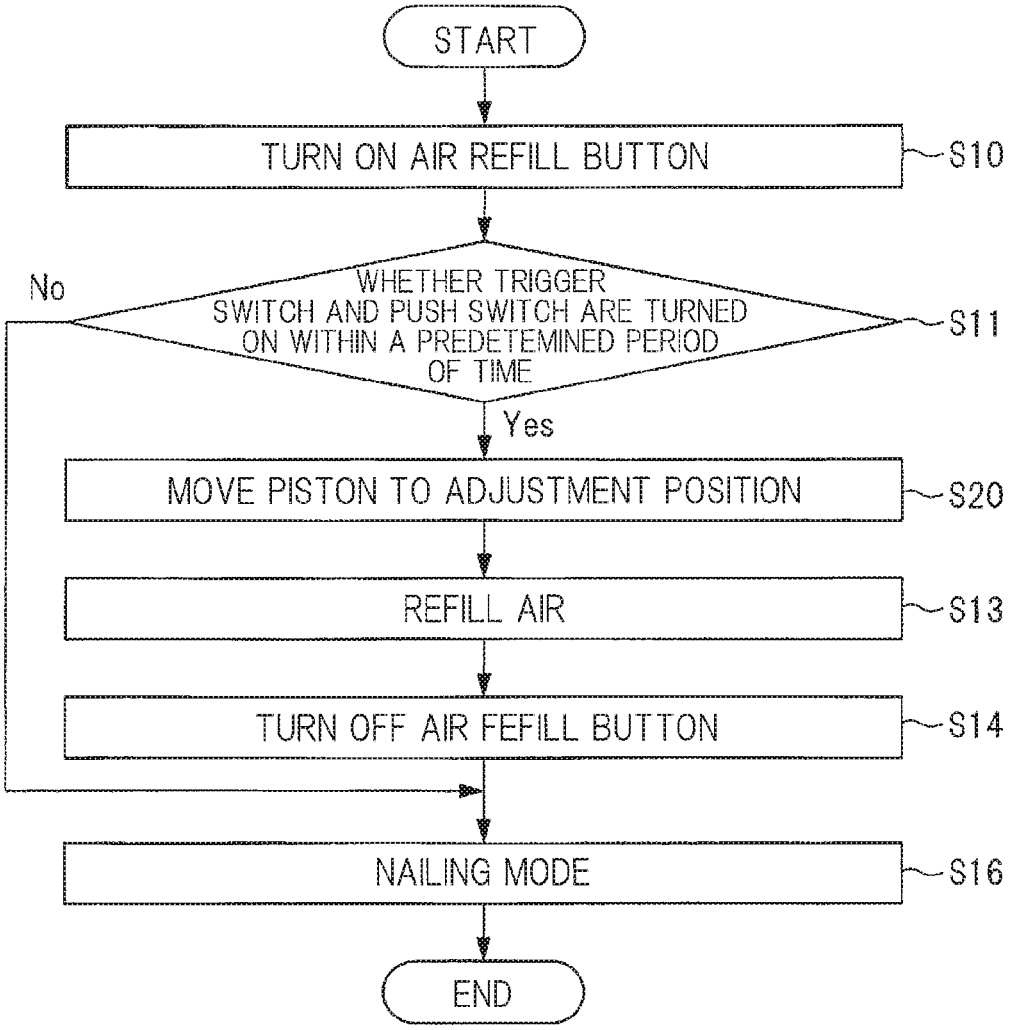
FIG. 9 is a flowchart showing a second control example of the driver.

In the second control example of FIG. 9, from the state where the piston 24 is stopped at the adjustment position, it proceeds to step S16 via step S14, and the nailing mode is selected. In the second control example of FIG. 9, it proceeds to step S16, and when the trigger switch 67 is turned on and the push switch 69 is turned on, the piston 24 is moved from the adjustment position toward the top dead center.

Figure 8:
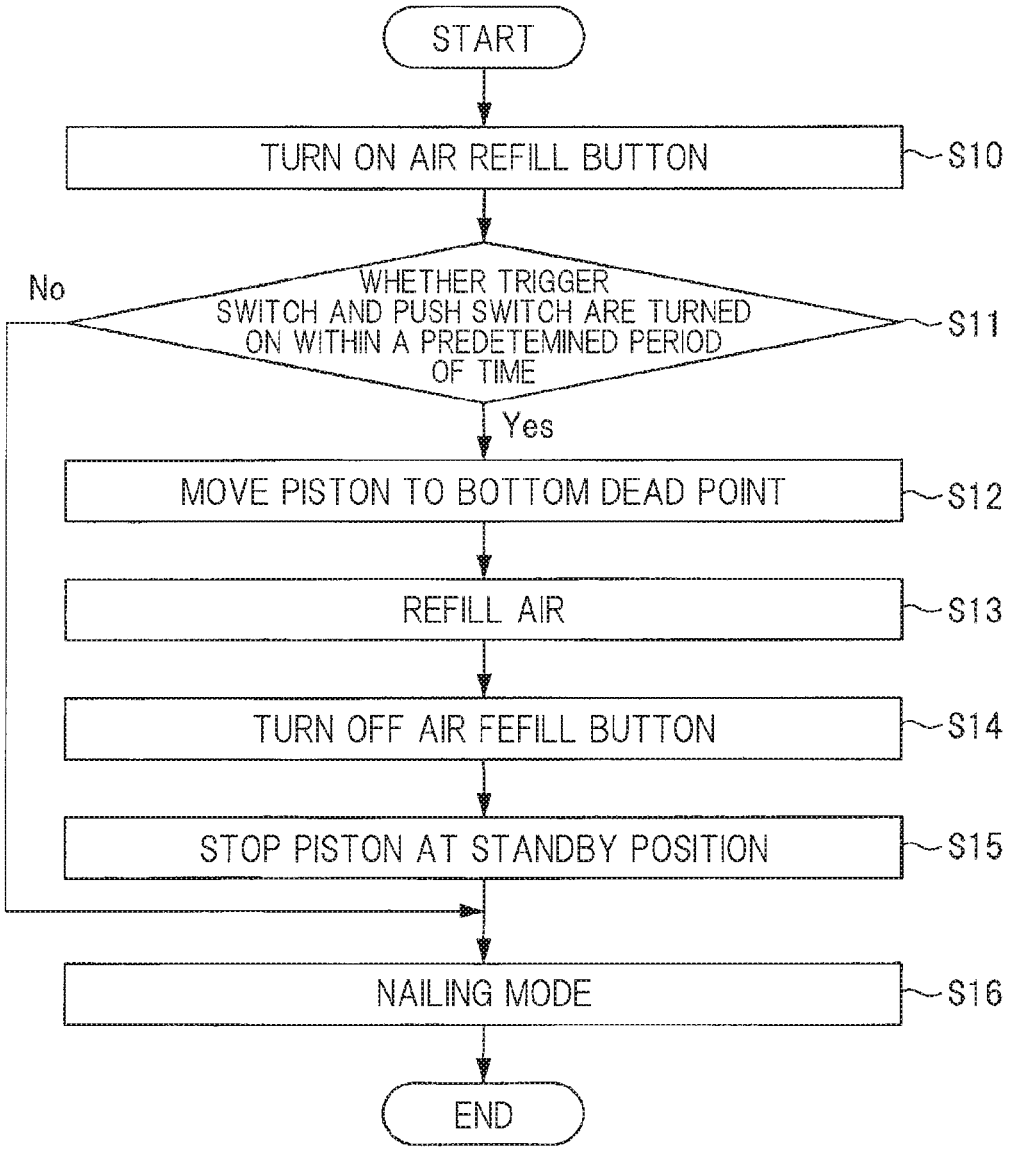
FIG. 8 is a flowchart showing a first control example of the driver.

Therefore, when the second control example of FIG. 9 is performed, the same effect as the first control example of FIG. 8 can be obtained.

Furthermore, when the piston 24 stops at the adjustment position as shown in FIG. 4, the tip 25A of the driver blade 25 is at the same position as the tip 35A of the nose portion 35 in the direction of the center line A1. In this state, it proceeds to step S16, and when the push lever 68 is pressed against the object material 70, the push switch 69 is turned on before the tip 25A of the driver blade 25 comes in contact with the object material 70. That is, the operation of switching the push switch 69 from OFF to ON is smoothly performed, and the nail 58 is driven.

As described above, when compressed air is injected into the pressure chamber 13, the piston 24 can be stopped at a position other than the top dead center, for example, at an adjustment position such as the bottom dead center. The adjustment position of the piston 24 can be arbitrarily changed. The refilling pressure can be reduced by bring the stop position of the piston 24 closer to the bottom dead center. In other words, in the case of refilling the pressure chamber 13 with compressed gas from the pressure regulator 94 of a type in which the supply pressure value is adjusted to one or a multiple of predetermined pressure values instead of an arbitrary pressure or a pressure supply means having a fixed supply pressure value, the predetermined pressure of the pressure chamber 13 to be filled can be arbitrarily set by changing the stop position of the piston 24. Therefore, it is possible to set the actual driving force of the driver 10 to a value corresponding to the target driving force.

Additionally, if the actual driving force is adjusted for each model of the driver 10 by changing the stop position of the piston 24, the pressure regulator 94 can be shared even when the model of the driver 10 is different. That is, even when the target driving force differs for each model of the driver 10, the pressure regulator 94 does not require to be changed, and the workability is improved.

Example of Phase Detection Sensor

Next, another example of the phase detection sensor 72 will be described with reference to FIGS. 10A and 10B. In the phase detection sensor 72, the permanent magnet 85A and the permanent magnet 85B are respectively disposed at positions different from each other in the rotation direction of the pin wheel 49. The Hall IC board 84 has a Hall element 84A configured to detect the permanent magnet 85A and a Hall element 84B configured to detect the permanent magnet 85B.

Figure 11:
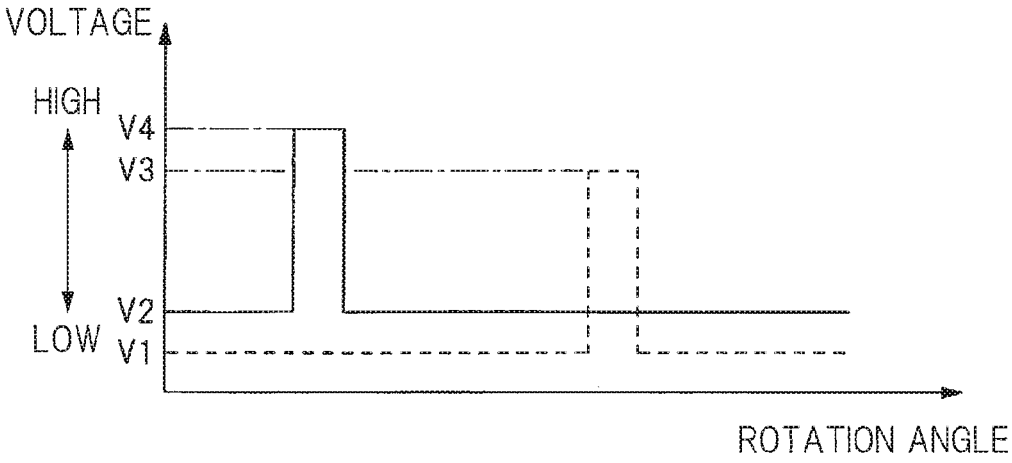
FIG. 11 is a diagram showing voltages of signals output from the phase detection sensors of FIGS. 10A and 10B.

The Hall element 84A detects a magnetic field formed by the permanent magnet 85A and outputs a signal. The Hall element 84B detects a magnetic field formed by the permanent magnet 85B and outputs a signal. The Hall element 84A is separated from the permanent magnet 85A, and the Hall element 84B is separated from the permanent magnet 85B. That is, the phase detection sensor 72 is a non-contact sensor. An example of the voltage of the signals of the Hall elements 84A and 84B is shown in the diagram of FIG. 11. In FIG. 11, the vertical axis represents the voltage, and the horizontal axis represents the rotation angle of the pin wheel 49. The voltage of the signal of the Hall element 84A is indicated by a solid line, and the voltage of the signal of the Hall element 84B is indicated by a dash line.

Figure 10A:
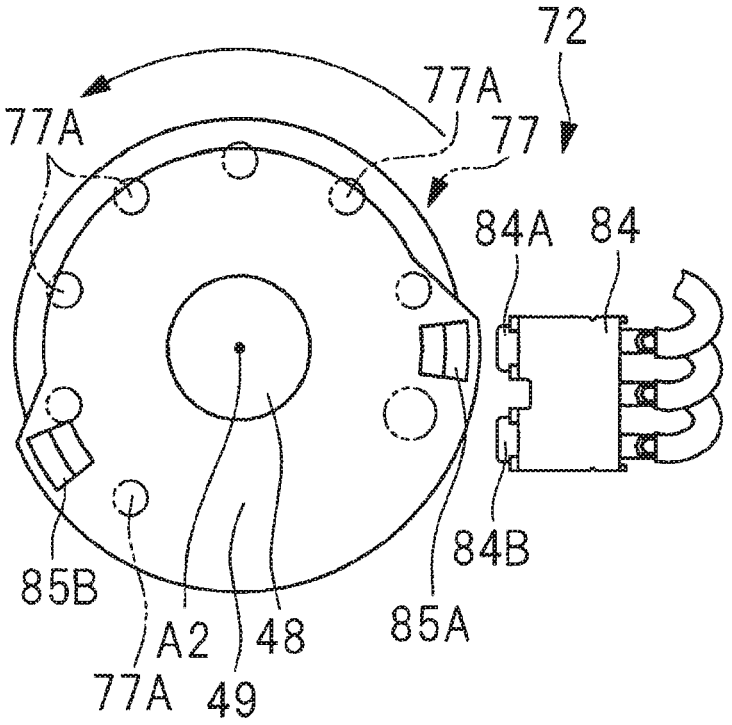
FIG. 10A is a diagram showing another example of the phase detection sensor.

When the signal of the Hall element 84A rises from the voltage V2 to the voltage V4 as shown in FIG. 11 while the pin wheel 49 is rotating in the counterclockwise direction as shown in FIG. 10A, the controller 63 is configured to determine that the piston 24 has reached the standby position.

Figure 10B:
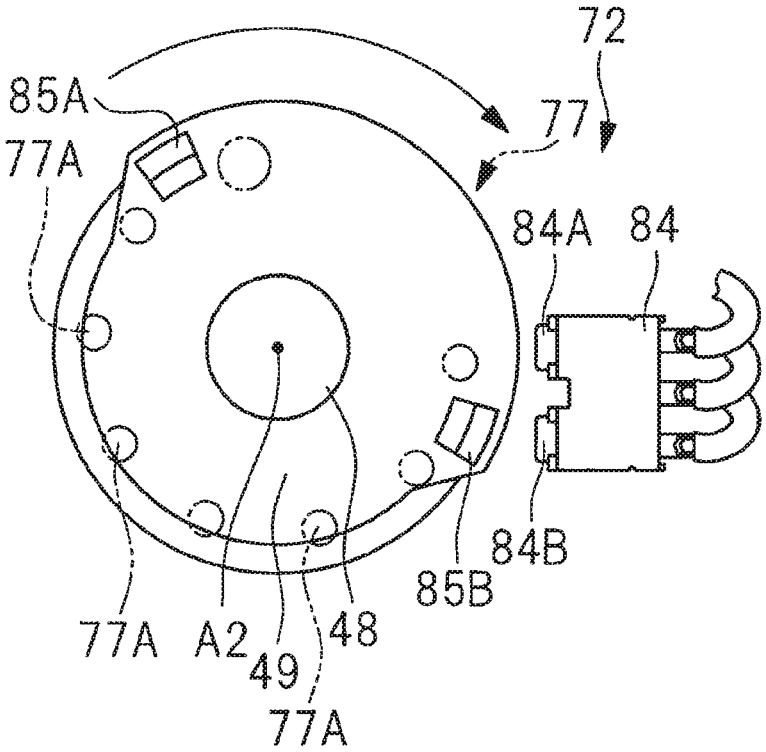
FIG. 10B is a diagram showing another example of the phase detection sensor.

As shown in FIG. 10B, when the pin wheel 49 is rotated in the clockwise direction to lower the piston 24 from the standby position and the signal of the Hall element 84B rises from the voltage V1 to the voltage V3 as shown in FIG. 11, the controller 63 determines that the piston 24 has reached the adjustment position.

Figure 12A:
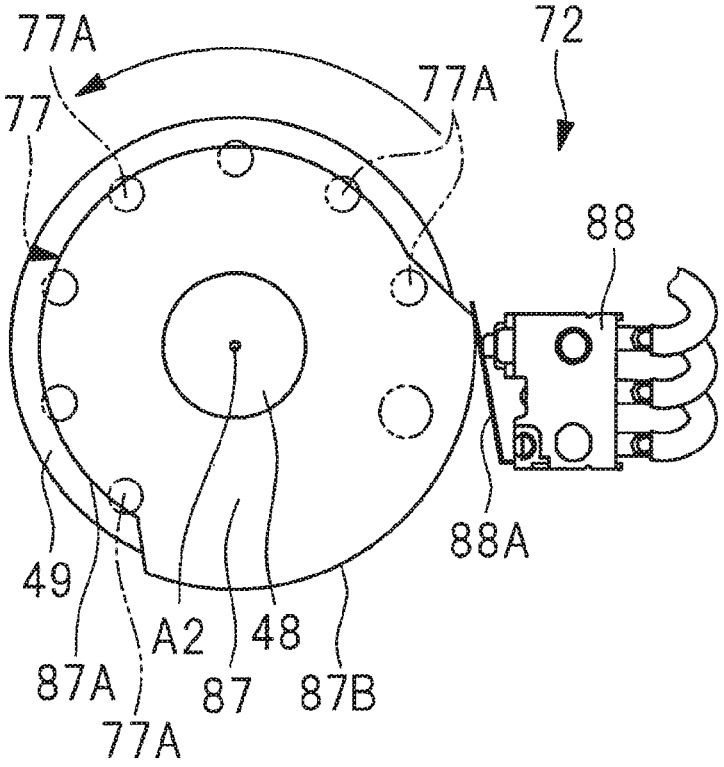
FIG. 12A is a diagram showing another example of the phase detection sensor.
Figure 12B:
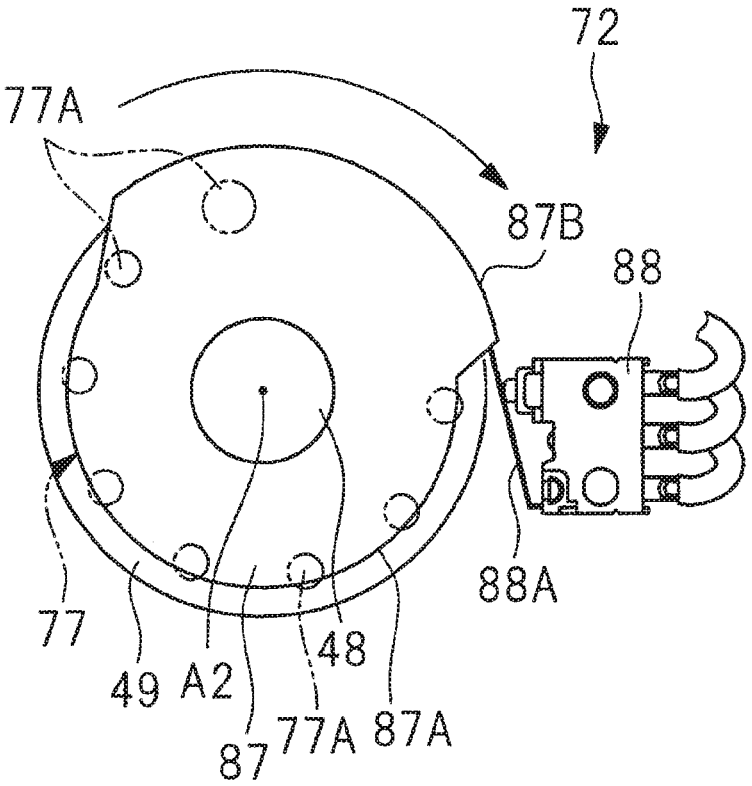
FIG. 12B is a diagram showing another example of the phase detection sensor.

Another example of the phase detection sensor 72 is shown in FIGS. 12A and 12B. The phase detection sensor 72 includes a cam 87 provided to the pin wheel 49 and a contact switch 88. The cam 87 has a cam surface 87A having a radius centered on the axis A2, and a cam surface 87B having a larger radius than the cam surface 87A. The cam surface 87A and the cam surface 87B are provided in respective ranges different from each other in the rotation direction of the pin wheel 49, and are connected to each other. The contact switch 88 has a contact piece 88A which contacts the cam surfaces 87A and 87B. The phase detection sensor 72 shown in FIGS. 12A and 12B is a contact sensor.

Figure 13:
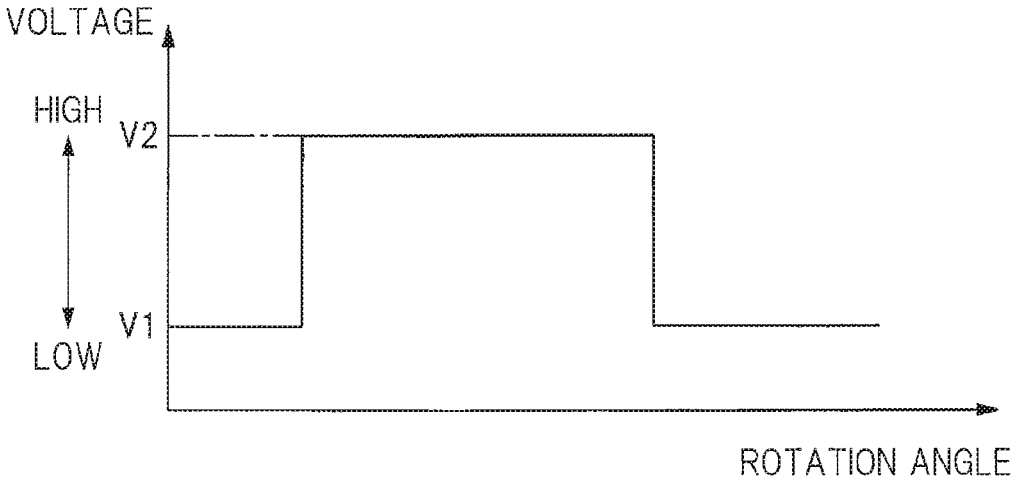
FIG. 13 is a diagram showing voltages of signals output from the phase detection sensors of FIGS. 12A and 12B.

An example of the voltage of the signal output from the phase detection sensor 72 of FIGS. 12A and 12B is shown in FIG. 13. In FIG. 13, the vertical axis represents the voltage, and the horizontal axis represents the rotation angle of the pin wheel 49. As shown in FIG. 12A, when the contact portion of the contact piece 88A is switched from the cam surface 87A to the cam surface 87B and rises from the voltage V1 to the voltage V2 as shown in FIG. 13 when the pin wheel 49 is rotated in the counterclockwise direction, the controller 63 determines that the piston 24 has reached the standby position.

As shown in FIG. 12B, when the pin wheel 49 is rotated in the clockwise direction to lower the piston 24 from the standby position, the contact point of the contact piece 88A switches from the cam surface 87B to the cam surface 87A, and decreases from the voltage V2 to the voltage V1 as shown in FIG. 13, the controller 63 determines that the piston 24 has reached the adjustment position.

Figure 14A:
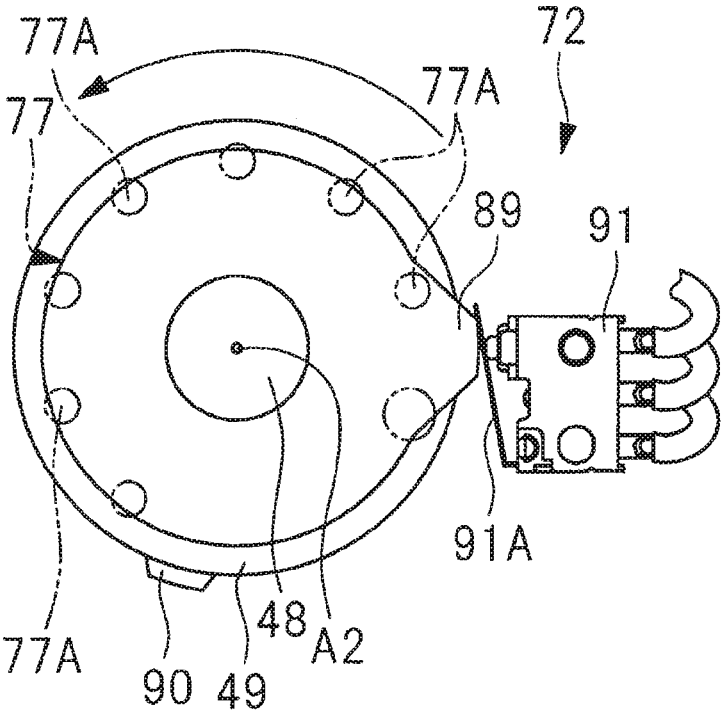
FIG. 14A is a diagram showing another example of the phase detection sensor.
Figure 14B:
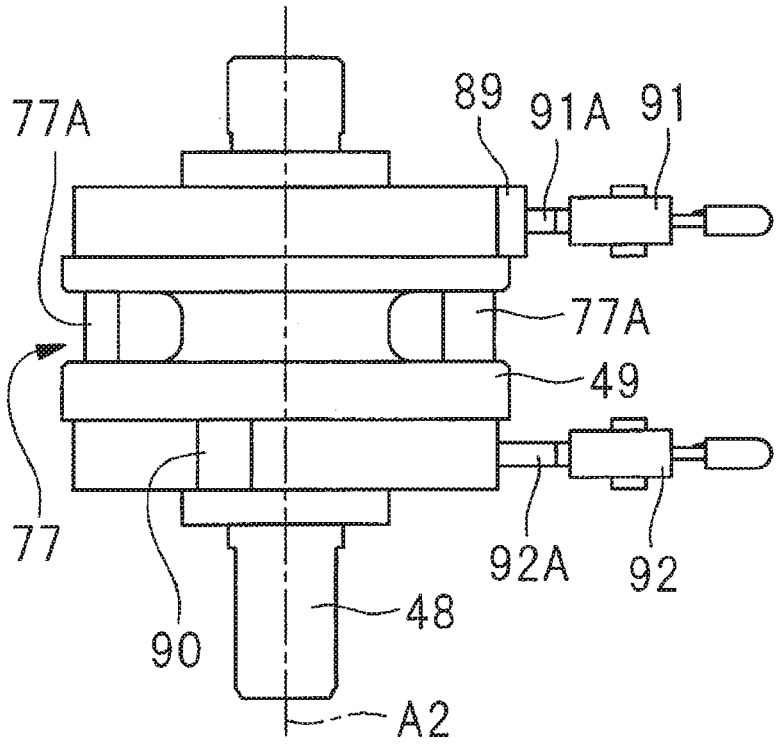
FIG. 14B is a diagram showing another example of the phase detection sensor.

Another example of the phase detection sensor 72 is shown in FIGS. 14A and 14B. The phase detection sensor 72 has: cams 89 and 90 provided to the pin wheel 49; and contact switches 91 and 92. The cams 89 and 90 are disposed at respective positions different from each other in the rotation direction of the pin wheel 49, and are disposed at respective positions different from each other in the direction of the axis A2. The cams 89 and 90 project in the radial direction of the pin wheel 49.

The contact switches 91 and 92 are arranged at respective positions different from each other in the direction of the axis A2. The contact switch 91 has a contact piece 91A, and the contact piece 91A contacts the cam 89 to detect the rotation angle of the pin wheel 49. The contact switch 92 has a contact piece 92A, and the contact piece 92A contacts the cam 90 to detect the rotation angle of the pin wheel 49. The phase detection sensor 72 shown in FIGS. 14A and 14B is a contact sensor.

Figure 15:
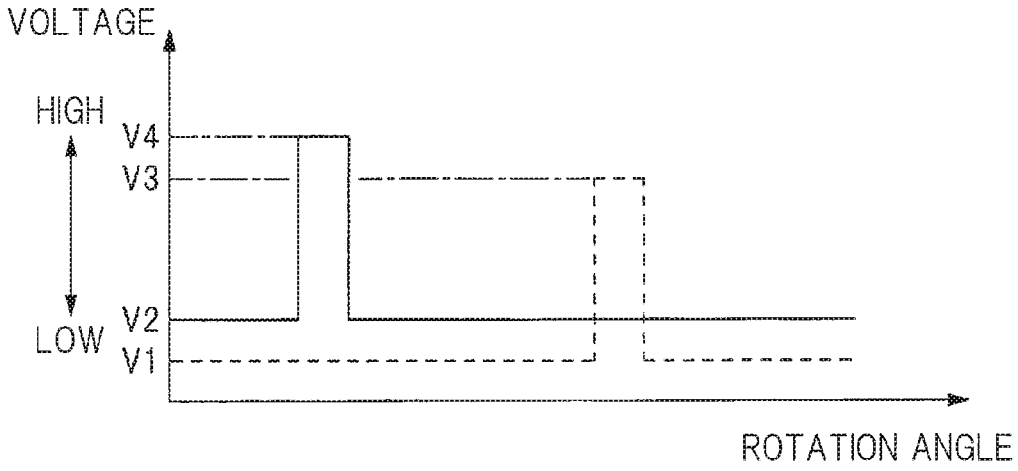
FIG. 15 is a diagram showing voltages of signals output from the phase detection sensors of FIGS. 14A and 14B.

An example of the voltage of the signal output from the phase detection sensor 72 of FIGS. 14A and 14B is shown in FIG. 15. In FIG. 15, the vertical axis represents the voltage, and the horizontal axis represents the rotation angle of the pin wheel 49. The voltage of the signal of the contact switch 91 is indicated by a solid line, and the voltage of the signal of the contact switch 92 is indicated by a dash line. As shown in FIG. 14A, when the contact piece 91A comes in contact with the cam 89 and rises from the voltage V2 to the voltage V4 as shown in FIG. 15 when the pin wheel 49 is rotating in the counterclockwise direction, the controller 63 determines that the piston 24 has reached the standby position.

When the pin wheel 49 is rotated in the clockwise direction to lower the piston 24 from the standby position, the contact piece 92A comes in contact with the cam 90, and rises from the voltage V1 to the voltage V3 as shown in FIG. 15, the controller 63 determines that the piston 24 has reached the adjustment position.

Third Control Example

Figure 16:
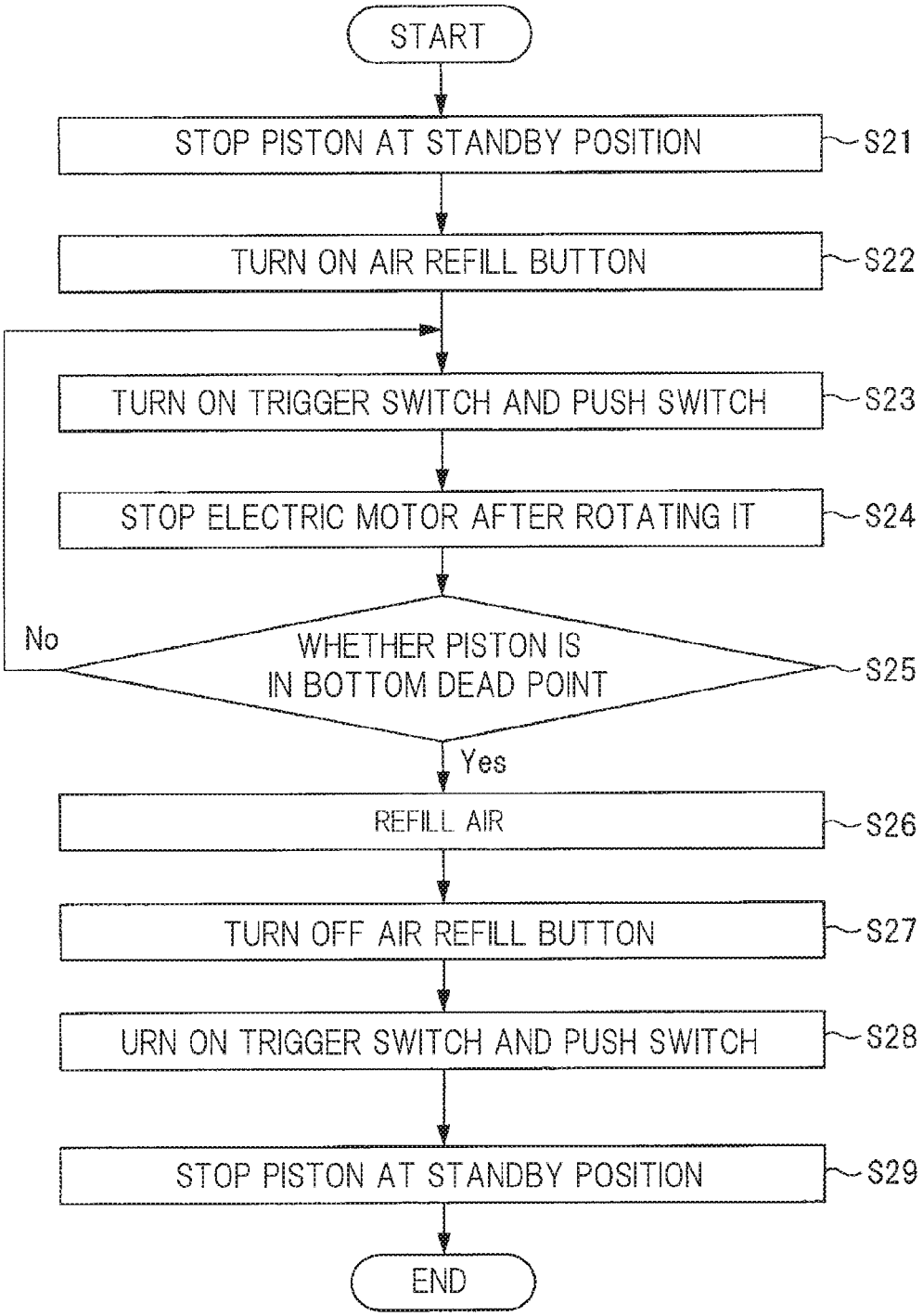
FIG. 16 is a flowchart showing a third control example of the driver.

The operation of injecting air into the pressure chamber 13 by the operator and the control example performed by the controller 63 will be described with reference to the third control example of FIG. 16. The third control example of FIG. 16 is performed with the nail 58 taken out from the magazine 59. If the magazine 59 is detachable from the housing 11, the magazine 59 may be detached from the housing 11.

In step S21, the controller 63 stops the impactor 12 at the standby position. That is, the piston 24 is in the standby position. When the air refilling button 71 is turned on in step S22, the controller 63 displays on the display 95 that the maintenance mode has been selected. In step S23, the operator applies an operation force to the trigger 66 and presses the push lever 68 against the object material 70. When the controller 63 detects that the trigger switch 67 has been turned on and the push switch 69 has been turned on, the electric motor 15 is stopped after the forward rotation of the electric motor 15 at a predetermined angle in step S24.

After the impactor 12 reaches the top dead center, the pin 77A and the projections 26A are released, and the impactor is moved from the top dead center toward the bottom dead center, the operator determines whether the impactor 12 reaches the bottom dead center in step S25. The operator can determine whether the impactor 12 has reached the bottom dead center by the vibration of the handle 18.

When the operator determines "NO" in step S25, the operation of pushing the trigger 66 and pushing the push lever against the object material 70 is repeated. When the operator determines "YES" in step S25, it performs an air refilling operation in step S26. The air refilling operation in step S26 is the same as the air refilling operation in step S13. As described above, in the third control example of FIG. 16, the operator performs the air refilling operation with the piston 24 pressed against the bumper 33 by air pressure and stopped at the bottom dead center.

After the air refilling operation in step S26, the operator turns off the air refilling button 71 and cancels the maintenance mode. When detecting that the trigger switch 67 is turned on and the push switch 69 is turned on in step S28, in step S29, the controller 63 rotates the electric motor 15 in the forward direction to move the piston 24 from the lower dead center to the standby position, stops the electric motor 15, and terminates the third control example. Therefore, the fourth control is to move the piston 24 from the bottom dead center to the standby position after compressed air is supplied to the pressure chamber 13.

In the third control example, the rotation and stop of the electric motor 15 are repeated before compressed air is injected into the pressure chamber 13. Then, the piston 24 reaches the top dead center, the projections 26A is released from the pin 77A, the piston 24 is moved from the top dead center toward the bottom dead center by the air pressure of the pressure chamber 13, and the air refilling operation is performed with the piston 24 stopped by colliding with the bumper 33. Therefore, the air pressure to be injected into the pressure chamber 13 can be set low.

Note that in step S25 of FIG. 16, the controller 63 can determine whether the piston 24 has reached the bottom dead center. The controller 63 can process the signal output from the phase detection sensor 72 to determine whether the piston has reached the bottom dead center. Then, when the controller 63 determines "No" in step S25, the controller 63 displays on the display 95 that it is not in a state ready for the air refilling operation, and the operator performs the operation of step S23. On the other hand, if the controller 63 determines "Yes" in step S25, the controller 63 displays on the display 95 that the air can be refilled, and the operator performs the operation of step S26.

Furthermore, it is possible to perform an interrupt step between step S25 and step S26. In this interrupting step, the electric motor 15 is rotated in the forward direction to move the piston 24 away from the bumper 33, and the piston 24 is stopped at the adjustment position between the standby position and the bottom dead center.

Another example of the driver 10 will be described with reference to FIGS. 17 and 18. The speed reducer 43 shown in FIGS. 17 and 18 has a rotational element 96, and the rotational element 96 is disposed in the gear case 42. A rotational element 96 is integrally rotatably coupled to the enter member 44. The rotational element 96 is connected to the output member 45 so as to be capable of power transmission. The rotational element 96 is rotatable about an axis A2.

Figure 17:
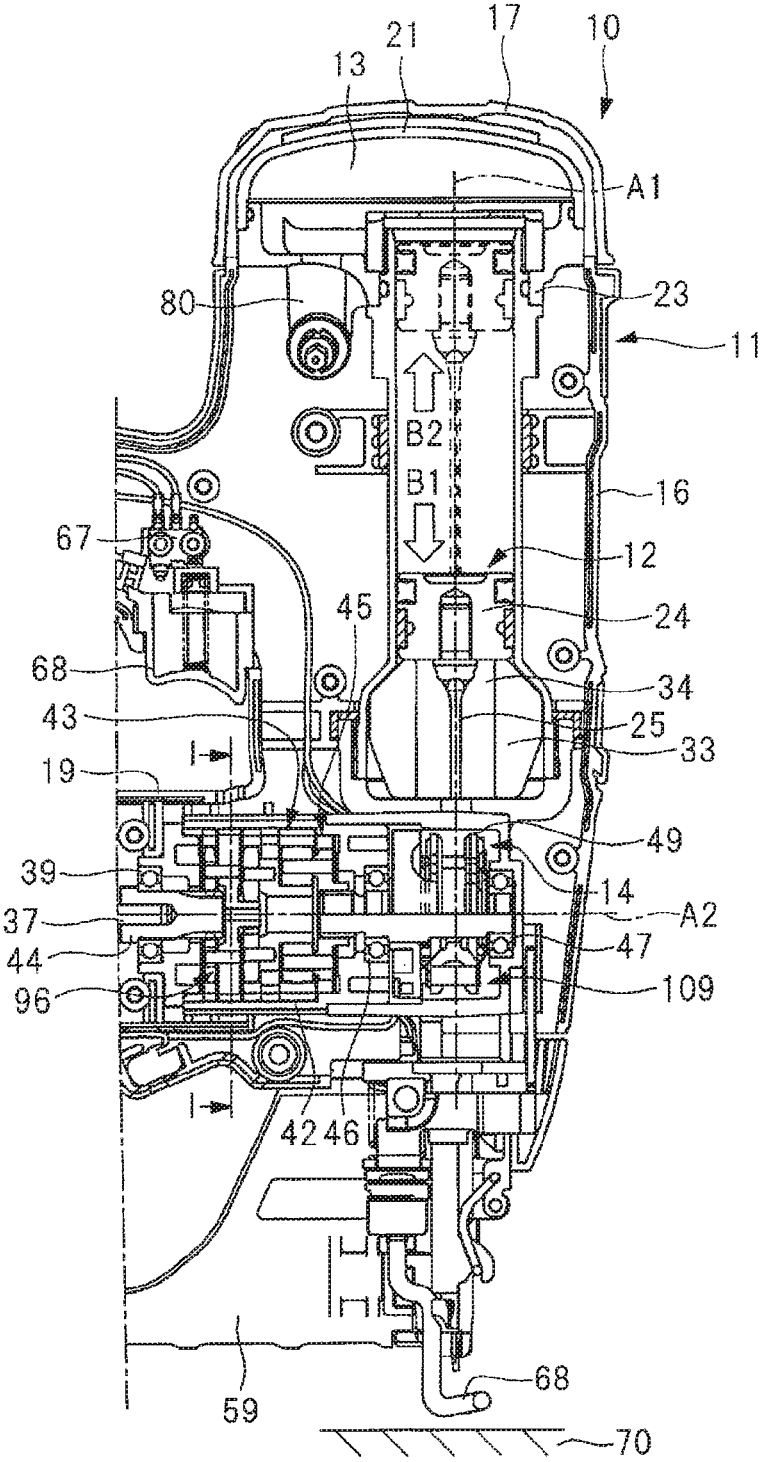
FIG. 17 is a side cross-sectional view of the driver according to another embodiment.
Figure 18:
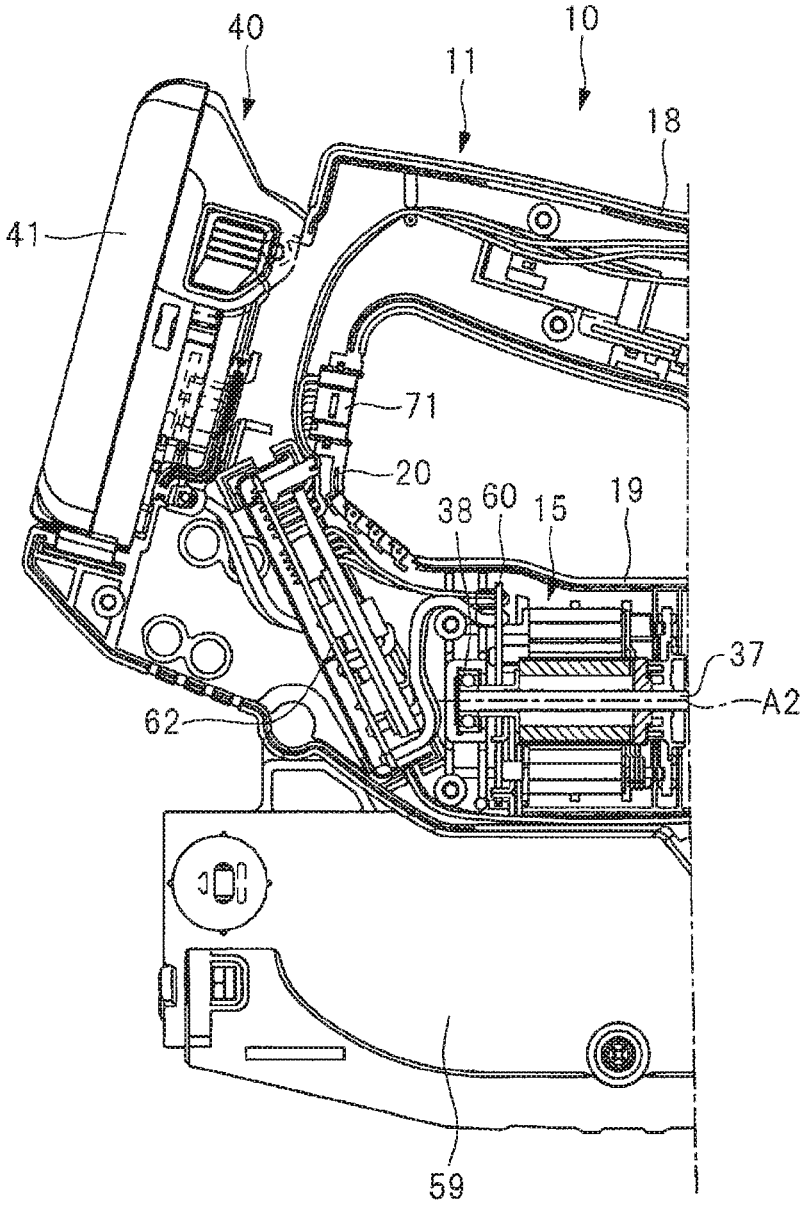
FIG. 18 is a side cross-sectional view of the driver according to another embodiment.

The driver 10 shown in FIGS. 17 and 18 has a rotation restricting mechanism 108. The configuration of the rotation restricting mechanism 108 will be described with reference to FIGS. 19 and 20. A multiple of engaging portions 97 are provided to the outer circumferential surface of the rotational element 96. The engaging portions 97 are spaced apart in the direction of rotation of the rotational element 96. The engaging portion 97 has a radially extended engaging surface 98 and a curved surface 99 of the rotational element 96. The curved surface 99 connects the tip of the engaging portion 97 and the inner end of the engaging surface 98.

A cylinder 100 is fixed to the outer surface of the motor accommodating portion 19. A plunger 101 is provided to the cylinder 100, and a spring 102 configured to urge the plunger 101 is provided. A hole 103 is provided in the motor accommodating portion 19, and a hole 104 is provided in the gear case 42. Part of the plunger 101 is disposed in the holes 103 and 104, and the tip of the plunger 101 is disposed in the gear case 42. The spring 102 is a compression spring made of metal, and the spring 102 is configured to urge the plunger 101 toward the rotational element 96. The plunger 101 has a flange 105 which is disposed within the cylinder 100. The lever 106 is movable in the radial direction of the rotational element 96.

A lever 106 is attached to the cylinder 100. The lever 106 can be operated within a predetermined angle range with the support shaft 107 as a fulcrum. A first end of the lever 106 is disposed outside the cylinder 100 and a second end of the lever 106 is disposed within the cylinder 100. The flange 105 is biased by the force of the spring 102 and is pressed against the second end of the lever 106. The lever 106, the plunger 101, the spring 102, and the engaging portion 97 constitute a rotation restricting mechanism 108. The rotation restricting mechanism 108 has a function of allowing the rotational element 96 to rotate counterclockwise in FIG. 19 by the power of the electric motor 15.

Figure 19:
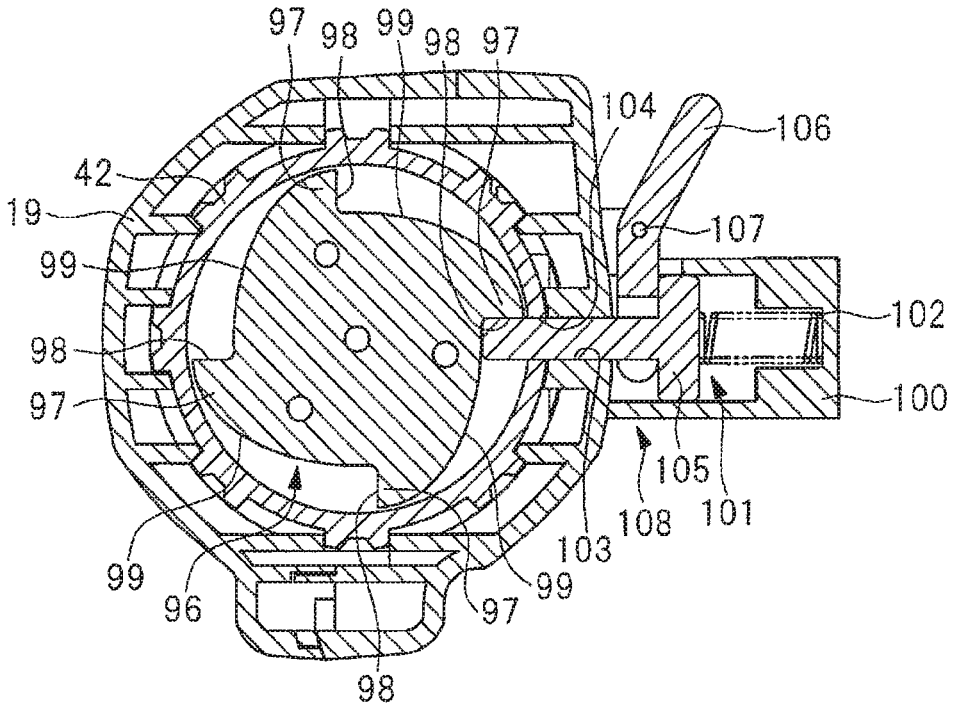
FIG. 19 is a cross-sectional view taken along line I-I of the driver of FIG. 17.
Figure 20:
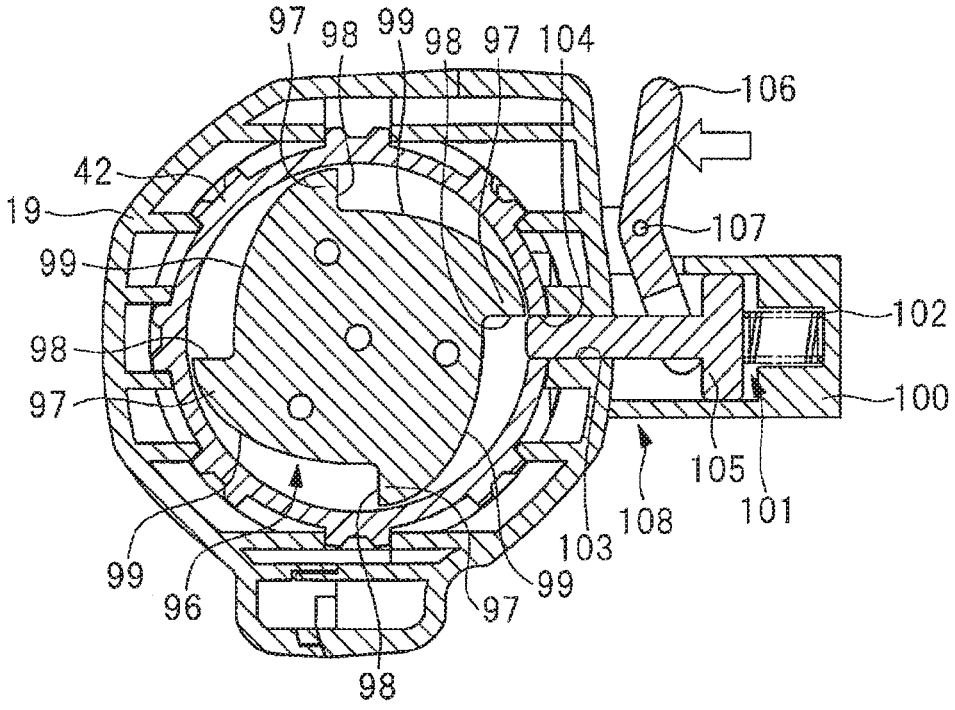
FIG. 20 is a cross-sectional view taken along line I-I of the driver of FIG. 17.

The rotation restricting mechanism 108 has: a first state preventing the rotational element 96 being rotated in the clockwise direction in FIG. 19 when the impactor 12 is urged toward the bottom dead center by the air pressure of the pressure chamber 13; and a second state allowing the rotational element 96 to be rotated in the clockwise direction in FIG. 20.

Next, the function and action of the rotation restricting mechanism 108 when the nail 58 is driven by the driver 10 will be described. When the operator does not apply an operation force to the lever 106, the first end of the plunger 101, which is biased by the force of the spring 102, is located in the gear case 42. When the electric motor 15 rotates in the forward direction and the rotational element 96 is rotated in the counterclockwise direction in FIG. 19, the first end portion of the plunger 101 is moved along the curved surface 99.

Therefore, the plunger 101 is actuated against the force of the spring 102 in a direction away from the rotational element 96. When the first end of the plunger 101 rides over the engaging portion 97, the plunger 101 is moved in a direction approaching the rotational element 96 by the urging force of the spring 102. While the electric motor 15 is rotated in the normal direction, the above operation is repeated, and the rotational element 96 is rotated in the counterclockwise direction in FIG. 19 by the power of the electric motor 15. The rotation force of the rotational element 96 is transmitted to the pin wheel 49, and while the projections 26A and the pin 77A are engaged with each other, the impactor 12 is moved toward the top dead center.

Furthermore, when the piston 24 reaches the standby position and the electric motor 15 stops, the piston 24 is urged by the pressure in the pressure chamber 13, and the pin wheel 49 receives a rotation force. Then, the rotation force received by the pin wheel 49 is transmitted to the rotational element 96, and the rotational element 96 receives the rotation force in the clockwise direction in FIG. 19. Then, the engaging surface 98 of the engaging portion 97 is engaged with the first end portion of the plunger 101, and the rotation of the rotational element 96 is prevented. Therefore, the piston 24 is held in the standby position.

Furthermore, the function and operation of the rotation regulating mechanism 108 when performing maintenance of the driver 10 will be described. Maintenance includes air refill works. When performing maintenance of the driver 10, the electric motor 15 is stopped, and as shown in FIG. 19, the engaging portion 97 is engaged with the first end portion of the plunger 101, and the rotational element 96 is stopped.

Note that when the operator applies an operation force to the lever 106 and operates the lever 106 at a predetermined angle as shown in FIG. 20, the plunger 101 is moved in a direction away from the rotational element 96 by the operation force of the lever 106 and stops. Thus, the first end of the plunger 101 is moved into the hole 104, and the first end of the plunger 101 is released from the engaging portion 97. Then, the rotational element 96 is rotated in the clockwise direction in FIG. 20 by the rotation force transmitted from the piston 24, and the piston 24 is moved from the standby position toward the bottom dead center by the air pressure of the pressure chamber 13. Then, the piston 24 stops by colliding with the bumper 33, and the rotational element 96 stops. The operator recognizes through his/her tactile sensation that the piston 24 has stopped by colliding with the bumper 33 and then releases the operation force applied to the lever 106.

Figure 21:
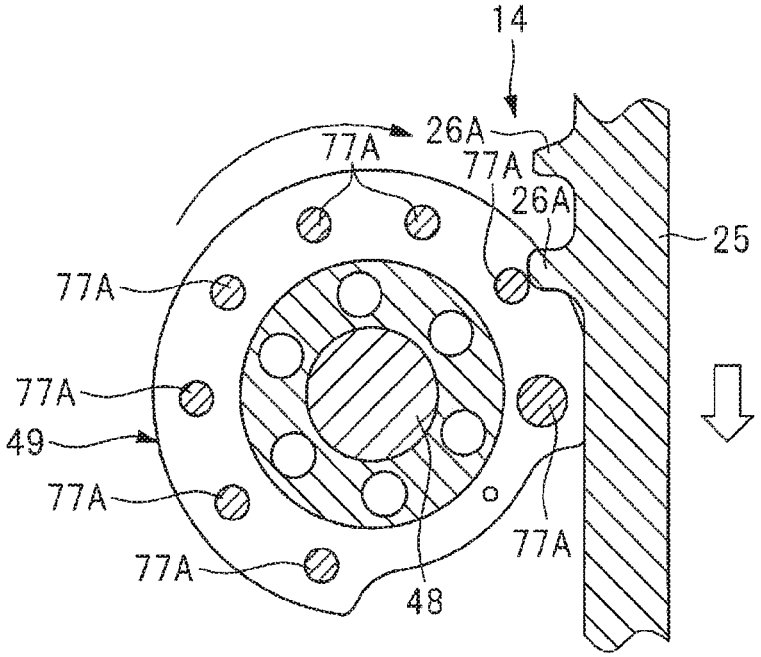
FIG. 21 is a cross-sectional view showing an operation of a power conversion mechanism provided to the driver of FIG. 17.
Figure 22:
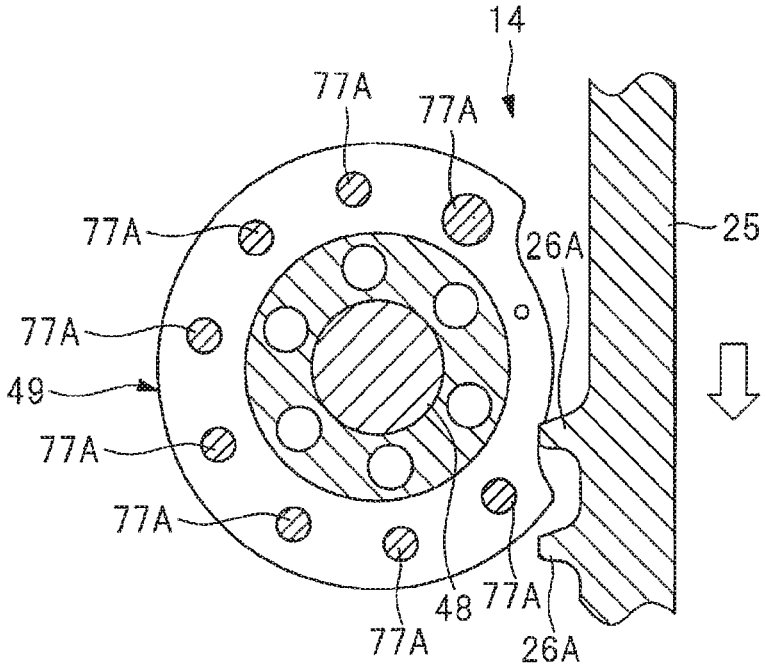
FIG. 22 is a cross-sectional view showing the operation of the power conversion mechanism provided to the driver of FIG. 17.

As described above, when doing maintenance of the driver 10, the rotational element 96 is rotatable in the clockwise direction in FIG. 20. Therefore, when the piston 24 is stopped at the standby position, as shown in FIG. 21, even if an engagement between the pin 77A and the projections 26A is unsuitable, the pin wheel 49 is allowed to rotate in the clockwise direction in FIG. 21 in accordance with the operation of the driver blade 25 to descend. Therefore, the projections 26A is separated from the engaged pin 77A, and as shown in FIG. 22, the projections 26A can be prevented from colliding with the other pin 77A.

In the driver 10 having the rotation restricting mechanism 108, if the controller 63 is configured to detect whether the operation force is applied to the lever 106, any of the controls shown in FIGS. 8, 9, and 16 can be executed. In this case, instead of detecting that the air refilling button is turned on in step S10 or step S22, it is detected that an operation force is applied to the lever 106. Instead of detecting the turning off of the air refilling button in step S14 or step S27, it is detected that the operation force of the lever 106 is released.

A meaning of matters explained in the above embodiment will be described below. The controller 63, the inverter circuit 61, the electric motor 15, and the power transmission route 109 are examples of the control mechanism 110 shown in FIG. 5. The controller 63, the trigger switch 67, and the push switch 69 are condition determination units. The valve 80 is a gas inlet, the top dead center is a first position, and the bottom dead center is a second position. The control for stopping the piston 24 at the standby position is the first control.

As in the third control example, the second control is to stop the electric motor 15 with the pinion mechanism 77 and the projections 26A released after the electric motor 15 is rotated in the forward direction, and to allow the piston 24 to stop in contact with the bumper 33.

As in the first control example, it is the third control that the electric motor 15 is rotated in the reverse direction to move the piston 24 from the standby position to the bottom dead center to allow the piston 24 to stop in contact with the bumper 33. As in the second control example, the third control is to reverse-rotate the electric motor 15 to move the piston 24 from the standby position to the adjustment position and allow the piston 24 to stop at a position away from the bumper 33. The nose portion 35 is an injection portion, and the nail 58 is an example of a stopper.

The air refilling button 71 is an example of the first operating portion, the second operating portion, and the third operating portion. That is, a physically identical element, i.e., a single air refilling button 71 serve as the first operating portion, the second operating portion, and the third operating portion. The push lever 68 is a pressing member. The trigger 66 and the push switch 69 are press sensors, and the pin wheel 49 is a rotational element. The electric motor 15 is a motor, and the phase detection sensor 72 and the controller 63 are detection mechanisms. In the above embodiment, the top dead center, the bottom dead center, the standby position, and the adjustment position of the impactor 12 are described with reference to the piston 24, but the top dead center, the bottom dead center, the standby position, and the adjustment position of the impactor 12 can be grasped with respect to the driver blade 25.

Furthermore, an engagement between the pinion mechanism 77 and the projections 26A corresponds to a connection of the power transmission route. A disengagement between the pinion mechanism 77 and the projections 26A corresponds to an interruption of the power transmission route. When the pin wheel 49 is rotated by the power of the electric motor 15, in FIGS. 3 and 4, the rotation direction of the electric motor 15 rotating the pin wheel 49 in the counterclockwise direction is the first rotation direction, and the rotation direction of the electric motor 15 rotating the pin wheel 49 in the clockwise direction is the second rotation direction. That is, the forward rotation of the electric motor 15 is the first rotation direction, and the reverse rotation of the electric motor 15 is the second rotation direction.

Furthermore, a state where the plunger 101 is in engagement with the engaging portion 97 as shown in FIG. 19 is the first state of the rotation restricting mechanism 108. On the other hand, a state where the plunger 101 is in disengagement from the engaging portion 97 as shown in FIG. 20 is the second state of the rotation restricting mechanism 108.

Additionally, the bumper 33 is one example of the stopper. Furthermore, the adjustment position of the percussion element 12 includes: a case where the piston 24 is positioned between the standby position and the bottom dead center; and a case where the piston 24 is stopped at the bottom dead center. Furthermore, when the piston 24 stops at the adjustment position, the tip 25A of the driver blade 25 may project from the tip 35A of the nose portion 35 in the direction of the center line A1 which is the moving direction of the impactor 12. Furthermore, the rotational element 96, the engaging portion 97, and the plunger 101 are one example of a clutch mechanism, and the lever 106 is one example of a cancel mechanism.

When the rotational element 96 is rotated by the rotation force of the electric motor 15 in the counterclockwise direction in FIG. 19, the rotational element 96 is in a forward rotation state, and when the rotational element 96 is rotated in the clockwise direction in FIG. 20, the rotational element 96 is in a reverse rotation state.

The driver is not limited to the above-described embodiment, and various modifications can be made without departing from the gist of the present invention. For example, bellows may be connected to the piston so that a pneumatic chamber is formed in the bellows. In the case of using the bellows, a rail may be used in place of a cylinder as a guide member for guiding the movement of the impactor.

The control mechanism and the condition determination units include a processor, a circuit, a storing device, a module and a unit. In place of the electric motor, an oil-hydraulic motor and a pneumatic motor may be included as a motor configured to move the impactor from the second position toward the first position. The electric motor may be either a brushed motor or a brushless motor. The power source of the electric motor may be either a DC power supply or an alternating current power source.

The detection mechanism includes a contact sensor and a non-contact sensor. The non-contact sensor includes a magnetic sensor and an optical sensor. In place of the mechanism configured to detect the rotation angle or phase of the pin wheel and indirectly detect the position of the impactor on the basis of the detection result, a mechanism configured to directly detect the position of the impactor may be included. The mechanism configured to directly detect the position of the impactor includes: a magnetic member attached to the impactor; and a magnetic sensor configured to detect the magnetic member. The power conversion mechanism includes a cam mechanism and a rack and pinion mechanism. In place of the pin wheel 49, As the rotational element to which a rotation force is transmitted from the motor, and the rotational element, a gear, a pulley, and a rotation shaft.

Additionally, with reference to FIGS. 3, 4, 6A, 6B, 12A, 12B, 14A, 14B, and 19-22, it is described that the pin wheel 49 is rotated in a counterclockwise and a clockwise direction. This definition is conveniently given in order to explain the rotation direction of the pin wheel 49 with the driver 10 viewed from its front in FIG. 3. A floor, a wall, a ceiling, a column, and a roof are included as an object material 70 into which the stopper is driven. Wood, concrete, and gypsum are included as material of the object material 70.

EXPLANATION OF REFERENCE CHARACTERS

10 driver,
12 impactor,
13 pressure chamber,
14 power conversion mechanism,
15 electric motor,
63 controller,
25A, 35A, 68A tip,
26 rack,
49 pin wheel,
58A head,
61 inverter circuit,
66 trigger,
67 trigger,
68 push lever,
69 push switch,
71 air refilling button,
72 phase detection sensor,
77 pinion mechanism,
80 valve,
96 rotational element,
97 engaging mechanism,
106 rotary force transmission mechanism,
110 rotary force transmission mechanism.

The invention claimed is:

1. A driver comprising:

an impactor configured to move from a first position toward a second position to hit a stopper;

a pressure chamber to be filled with gas for moving the impactor from the first position toward the second position; and a control mechanism configured to move the impactor from the second position toward the first position, wherein the control mechanism comprises:

a motor configured to move the impactor; and a controller configured to control the motor, the controller is configured to set (1) a nailing mode in which the impactor hits the stopper and (2) a maintenance mode in which the impactor does not hit the stopper, the control mechanism is configured to control the impactor to stop at a standby position between the second position and the first position, in the nailing mode, the control mechanism is configured to control a continuous series of actions of the impactor, the continuous series of actions including (1) moving the impactor from the standby position toward the first position, (2) moving the impactor from the second position to the standby position after the impactor is moved from the first position toward the second position by the gas in the pressure chamber, and (3) stopping the impactor at the standby position, and in the maintenance mode, the control mechanism is configured to stop the impactor at an adjustment position closer to the second position than the standby position.

2. The driver according to claim 1, wherein
the control mechanism further comprises
a motor; and
a power transmission path configured to transmit power from the motor to move the impactor from the second position to the first position, wherein
in the nailing mode, the control mechanism is configured to close the power transmission path to move the impactor from the second position toward the first position, and stop the impactor at the standby position, and
in the maintenance mode, the control mechanism is configured to open the power transmission path to stop the impactor at the adjustment position.

3. The driver according to claim 1, wherein
the control mechanism comprises:
a power transmission path configured to transmit power from the motor to move the impactor from the second position to the first position, wherein
in the nailing mode, the control mechanism is configured to close the power transmission path to move the impactor from the second position toward the first position, and stop the impactor at the standby position, and
in the maintenance mode, the control mechanism is configured to close the power transmission path to move the impactor, and stop the impactor at the adjustment position.

4. The driver according to claim 1, wherein
after the maintenance mode is canceled, the control mechanism is configured to move the impactor from the adjustment position to the standby position.

5. The driver according to claim 1, further comprising a condition judging section configured to judge whether a condition impacting the stopper is satisfied, wherein
the standby position is closer to the first position than an intermediate position between the second position and the first position, and
the control mechanism is configured to:
stop the impactor at the standby position when the condition is not satisfied; and
move the impactor from the standby position to the first position when the condition is satisfied.

6. The driver according to claim 1, wherein the adjustment position is the second position.

7. The driver according to claim 6, further comprising a damper configured to stop the impactor at the second position by coming in contact with the impactor when the impactor is moved by a force from the pressure chamber.

8. The driver according to claim 1, further comprising an operating portion, wherein
when the operating portion is operated by an operator, the controller is configured to set the maintenance mode.

9. The driver according to claim 4, further comprising an operating portion, wherein
when the operating portion is operated by an operator, the controller is configured to cancel the maintenance mode.

10. The driver according to claim 1, further comprising:
a pressing member that is pressed against an object material into which the stopper is driven; and
a trigger that is operated by an operator when the stopper is driven into the object material,
when the pressing member is pressed against the object material and an operation force is applied to the trigger, within a predetermined period of time after the maintenance mode is set, the control mechanism is configured to stop the impactor at the adjustment position, and
when the pressing member is not pressed against the object material or/and the operation force is not applied to the trigger, within the predetermined period of time after the maintenance mode is set, the controller is configured to set the nailing mode.

11. The driver according to claim 1, further comprising a pressing member that is pressed against an object material into which the stopper is driven, wherein
a tip of the impactor stopping at the standby position is positioned between a head of the stopper and a tip of the pressing member.

12. The driver according to claim 1, further comprising an injection portion to which the stopper is supplied and in which the impactor is movably arranged, and a tip of the impactor stopping at the adjustment position protrudes from a tip of the injection portion in a moving direction of the impactor.

13. The driver according to claim 1, further comprising a detection mechanism configured to detect that the impactor is in the standby position, and that the impactor is in the adjustment position.

14. The driver according to claim 3, wherein the motor has:
a first rotation direction which is a rotation direction to move the impactor from the second position toward the first position; and
a second rotation direction which is opposite to the first rotation direction to move the impactor from the standby position toward the adjustment position.

15. The driver according to claim 14, wherein
the power transmission path has a rotation preventing mechanism configured to prevent the rotation of the electric motor, and
the rotation preventing mechanism has:
a first state allowing the motor to be rotated in the first rotational direction when the impactor is moved from the second position to the first position by the power of the motor, and preventing the motor from rotating in the second rotational direction; and
a second state allowing the motor to be rotated in the second rotational direction when the impactor is moved from the standby position to the adjustment position by a pressure of the pressure chamber.

16. The driver according to claim 15, wherein
the rotation preventing mechanism has a clutch mechanism and a cancel mechanism,
the clutch mechanism has: a rotational element that is integrally rotated in a forward direction together with the motor; an engaging portion provided to the rotational element; and a plunger engaged with the engaging portion to restrict the rotation of the rotational element in a direction opposite to the forward direction, and
the cancel mechanism has: a lever configured to move the plunger and to cause the plunger to be disengaged from the engaging portion,
in the first state, the plunger is engaged with the engaging portion to prevent the rotational element from being rotated in a reverse direction, and
in the second state, the lever causes the plunger and the engaging portion to be disengaged from each other, and allows the rotational element to be rotated in the reverse direction.

17. The driver according to claim 1, further comprising a damper configured to absorb a kinetic energy of the impactor, wherein the adjustment position is a position where the impactor and damper contact each other.

18. A driver comprising:

an operating portion that is operated by an operator;

an impactor configured to move from a first position toward a second position to hit a stopper;

a pressure chamber to be filled with gas for moving the impactor from the first position toward the second position; and a control mechanism configured to move the impactor from the second position toward the first position, wherein the control mechanism comprises:

a motor configured to rotate a rotating member to move the impactor; and a controller configured to control the motor, when the operating portion is operated, the control mechanism is configured to control a continuous series of actions of the impactor, the continuous series of actions including (1) moving the impactor from a standby position toward the first position by engagement of the rotating member with the impactor, (2) moving the impactor from the second position to the standby position after the engagement of the rotating member with the impactor is released at the first position and the impactor is moved from the first position toward the second position by the gas in the pressure chamber, and (3) stopping the impactor at the standby position, and the control mechanism is configured to control the impactor to stop at (1) the standby position between the second position and the first position, and (2) an adjustment position farther from the first position than the standby position.

19. The driver according to claim 18, wherein a damper configured to absorb a kinetic energy of the impactor, and the adjustment position is a position where the impactor and damper contact each other.

20. A method for controlling a driver, the driving comprising:

an impactor configured to move from a first position toward a second position to hit a stopper;

a pressure chamber to be filled with gas for moving the impactor from the first position toward the second position;

a control mechanism configured to move the impactor from the second position toward the first position, the control mechanism comprising a motor configured to move the impactor; and a controller configured to control the motor, the controller being configured to set (1) a nailing mode in which the impactor hits the stopper and (2) a maintenance mode in which the impactor does not hit the stopper, the method comprising:

controlling the impactor to stop at a standby position between the second position and the first position;

in the nailing mode, controlling a continuous series of actions of the impactor, the continuous series of actions including (1) moving the impactor from the standby position toward the first position, (2) moving the impactor from the second position to the standby position after the impactor is moved from the first position toward the second position by the gas in the pressure chamber, and (3) stopping the impactor at the standby position; and in the maintenance mode, stopping the impactor at an adjustment position closer to the second position than the standby position.

* * * * *